US010934794B2

(12) United States Patent
Knight et al.

(10) Patent No.: US 10,934,794 B2
(45) Date of Patent: Mar. 2, 2021

(54) SYSTEMS AND METHODS FOR SETTING A DOWNHOLE PLUG USING A SELF DAMPING SETTING TOOL

(71) Applicant: G&H Diversified Manufacturing LP, Houston, TX (US)

(72) Inventors: Benjamin Vascal Knight, Houston, TX (US); Joe Noel Wells, Lindale, TX (US); Steven Zakharia, Houston, TX (US); Anthony Nguyen, Houston, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 0 days.

(21) Appl. No.: 16/783,851

(22) Filed: Feb. 6, 2020

(65) Prior Publication Data

US 2020/0248516 A1 Aug. 6, 2020

Related U.S. Application Data

(60) Provisional application No. 62/801,854, filed on Feb. 6, 2019, provisional application No. 62/929,290, filed on Nov. 1, 2019.

(51) Int. Cl.
*E21B 23/06* (2006.01)
*E21B 33/128* (2006.01)

(52) U.S. Cl.
CPC ..... *E21B 23/06* (2013.01); *E21B 33/128* (2013.01)

(58) Field of Classification Search
CPC ..... E21B 23/06; E21B 33/128
See application file for complete search history.

(56) References Cited

U.S. PATENT DOCUMENTS 2,644,529 A 7/1953 Baker
3,055,430 A * 9/1962 Campbell ..... E21B 33/1295 166/122
3,186,485 A * 6/1965 Owen ..... E21B 23/065 166/63
3,298,437 A * 1/1967 Conrad ..... E21B 33/1293 166/63

(Continued)

FOREIGN PATENT DOCUMENTS

WO 2017087504 A1 5/2017

OTHER PUBLICATIONS

International Search Report and Written Opinion dated Jun. 10, 2020, for International Application No. PCT/US2020/017036.

*Primary Examiner* — Michael R Wills, III
(74) *Attorney, Agent, or Firm* — Conley Rose, P.C.

(57) ABSTRACT

A setting tool for actuating a downhole plug in a wellbore includes a housing including a central passage, a piston slidably disposed in the housing and including a central passage, and wherein the piston includes a first position in the housing and a second position the housing spaced from the first position in a first axial direction, and an atmospheric chamber filled with compressible fluid formed radially between the piston and the housing, and wherein the atmospheric chamber is sealed from an environment surrounding the setting tool when the piston is in the first position, wherein, in response to a pressurization of the central passage of the piston, the setting tool is configured to displace the piston from the first position to the second position and compress the compressible fluid within the atmospheric chamber.

24 Claims, 24 Drawing Sheets

(56) References Cited

U.S. PATENT DOCUMENTS

| | | | | |
|---|---|---|---|---|
| 7,000,705 | B2 | 2/2006 | Buyers et al. | |
| 7,681,652 | B2 | 3/2010 | Gaudette et al. | |
| 7,913,770 | B2 | 3/2011 | Schrammb et al. | |
| 8,196,515 | B2 | 6/2012 | Streibich et al. | |
| 8,517,115 | B2 | 8/2013 | Watson | |
| 8,881,834 | B2 | 11/2014 | Lauderdale | |
| 9,512,689 | B2 | 12/2016 | Frazier | |
| 9,771,769 | B2 | 9/2017 | Baker et al. | |
| 9,810,035 | B1 | 11/2017 | Carr et al. | |
| 9,890,604 | B2 | 2/2018 | Wood et al. | |
| 10,060,213 | B2 | 8/2018 | Maenza et al. | |
| 10,246,961 | B2 | 4/2019 | Robertson et al. | |
| 10,352,119 | B2 | 7/2019 | Doane et al. | |
| 10,352,120 | B2 | 7/2019 | Ewing et al. | |
| 2011/0108285 | A1* | 5/2011 | Fagley, IV | E21B 23/04 166/373 |
| 2015/0013991 | A1 | 1/2015 | Angman et al. | |
| 2017/0051603 | A1* | 2/2017 | Lee | E21B 47/0905 |
| 2018/0080298 | A1* | 3/2018 | Covalt | E21B 23/065 |
| 2019/0106956 | A1* | 4/2019 | Wells | E21B 33/12 |
| 2019/0277103 | A1* | 9/2019 | Wells | E21B 33/1204 |
| 2020/0018132 | A1* | 1/2020 | Ham | E21B 23/04 |
| 2020/0080394 | A1* | 3/2020 | Slup | E21B 23/01 |
| 2020/0095838 | A1* | 3/2020 | Baker | E21B 23/06 |

* cited by examiner

SYSTEMS AND METHODS FOR SETTING A DOWNHOLE PLUG USING A SELF DAMPING SETTING TOOL

CROSS-REFERENCE TO RELATED APPLICATIONS

This application claims benefit of U.S. provisional patent application Ser. No. 62/801,854 filed Feb. 6, 2019, and entitled "Systems and Methods for Setting a Downhole Plug Using a Self Damping Setting Tool," and of U.S. provisional patent application Ser. No. 62/929,290 filed Nov. 1, 2019, and entitled "Systems and Methods for Setting a Downhole Plug Using a Self Damping Setting Tool," each of which is hereby incorporated herein by reference in its entirety.

STATEMENT REGARDING FEDERALLY SPONSORED RESEARCH OR DEVELOPMENT

Not applicable.

BACKGROUND

After a wellbore has been drilled through a subterranean formation, the wellbore may be cased by inserting lengths of pipe ("casing sections") connected end-to-end into the wellbore. Threaded exterior connectors known as casing collars may be used to connect adjacent ends of the casing sections at casing joints, providing a casing string including casing sections and connecting casing collars that extends from the surface towards the bottom of the wellbore. The casing string may then be cemented into place to secure the casing string within the wellbore.

In some applications, following the casing of the wellbore, a wireline tool string may be run into the wellbore as part of a "plug-n-perf" hydraulic fracturing operation. The wireline tool string may include a perforating gun for perforating the casing string at a desired location in the wellbore, a downhole plug that may be set to couple with the casing string at a desired location in the wellbore, and a setting tool for setting the downhole plug. In certain applications, once the downhole plug has been set and the casing string has been perforated by the perforating gun, a ball or dart may be pumped into the wellbore for landing against the set downhole plug, thereby isolating the portion of the wellbore extending uphole from the set downhole plug. With this uphole portion of the wellbore isolated, the formation extending about the perforated section of the casing string may be hydraulically fractured by fracturing fluid pumped into the wellbore.

SUMMARY OF THE DISCLOSURE

An embodiment of a setting tool for actuating a downhole plug in a wellbore comprises a housing comprising a central passage, a piston slidably disposed in the housing and comprising a central passage, and wherein the piston comprises a first position in the housing and a second position the housing spaced from the first position in a first axial direction, and an atmospheric chamber filled with compressible fluid formed radially between the piston and the housing, and wherein the atmospheric chamber is sealed from an environment surrounding the setting tool when the piston is in the first position, wherein, in response to a pressurization of the central passage of the piston, the setting tool is configured to displace the piston from the first position to the second position and compress the compressible fluid within the atmospheric chamber. In some embodiments, an annular first seal assembly is positioned radially between an inner surface of the housing and an outer surface of the piston and restricts fluid communication between the atmospheric chamber and the environment surrounding the setting tool, and a groove is formed in the outer surface of the piston, and wherein the piston comprises a third position wherein the first seal assembly is positioned axially between a first end and a second end of the first seal assembly whereby fluid communication is provided between the atmospheric chamber and the environment surrounding the setting tool. In some embodiments, an annular second seal assembly is positioned radially between the inner surface of the housing and the outer surface of the piston and is axially spaced from the first seal assembly, an annular third seal assembly is positioned radially between the inner surface of the housing and the outer surface of the piston and is positioned axially between the first seal assembly and the second seal assembly, and an annular pressure chamber extends from the second seal assembly to the third seal assembly, and wherein the pressure chamber is in fluid communication with the central passage of the piston via a port formed in the piston. In certain embodiments, an inner diameter of the first seal assembly is greater than an inner diameter of the third seal assembly. In certain embodiments, the second seal assembly restricts fluid communication between the pressure chamber and the environment surrounding the setting tool when the piston is in the first position, the outer surface of the piston comprises a recess formed therein, and wherein the second seal assembly is positioned axially between the recess and the first seal assembly when the piston is in the first position, and at least a portion of the recess is positioned axially between the second seal assembly and the first seal assembly when the piston is in the third position. In certain embodiments, the setting tool further comprises an annular impact ring positioned about the piston, and wherein the second seal assembly is positioned axially between the impact ring and the first seal assembly, wherein the impact ring is configured to impact a shear cap connectable to an end of the piston when the setting tool is actuated from the first position to the second position. In some embodiments, the impact ring comprises a material having a hardness that is less than a hardness of a material comprising the housing. In some embodiments, the setting tool further comprises a piston adapter configured to releasably couple to the piston via a first internal connector of the piston adapter that is positioned on an inner surface thereof, and wherein the piston adapter comprises a second internal connector positioned on the inner surface of thereof and an external connector positioned on an outer surface thereof.

An embodiment of a setting tool for actuating a downhole plug in a wellbore comprises a housing comprising a central passage, and a piston slidably disposed in the housing and comprising a central passage, a first end, and a second end configured to couple with a mandrel of the downhole plug, and wherein the piston comprises a first position in the housing and a second position the housing spaced from the first position in a first axial direction, and an annular pressure chamber positioned radially between an inner surface of the housing and an outer surface of the piston, and wherein the pressure chamber is in fluid communication with the central passage of the piston via a port formed in the piston, and an annular impact ring positioned about the piston, and wherein the impact ring is positioned axially between the pressure chamber and the second end of the piston, and wherein the impact ring is configured to impact a shear cap connectable to an end of the piston when the setting tool is actuated from the first position to the second position, wherein, in response to a pressurization of the central passage of the piston, the setting tool is configured to displace the piston from the first position to the second position. In some embodiments, the impact ring comprises a material having a hardness that is less than a hardness of a material comprising the housing. In some embodiments, the setting tool comprises a sealed chamber formed around the piston and which is sealed from an environment surrounding the setting tool by an annular first seal assembly, a radial port formed in the housing and comprising a vent orifice, wherein a plug is removeably positioned in the radial port, wherein, in response to the pressurization of the central passage of the piston of the setting tool, the setting tool is configured to eject the plug from the radial port to permit fluid communication between the sealed chamber and the environment surrounding the setting tool. In some embodiments, a ratio of a surface area of the vent orifice and an axially-projected surface area of the piston is between 0.1% and 0.95%. In certain embodiments, the sealed chamber is filled with hydraulic oil. In certain embodiments, the sealed chamber comprises an atmospheric chamber filled with compressible fluid. In some embodiments, the setting tool comprises a piston adapter configured to releasably couple to the second end of the piston via a first internal connector of the piston adapter that is positioned on an inner surface thereof, and wherein the piston adapter comprises a second internal connector positioned on the inner surface of thereof and an external connector positioned on an outer surface thereof. In some embodiments, a groove is formed in the outer surface of the piston, and wherein the piston comprises a third position positioned axially between the first position and the second position, and wherein fluid communication is provided between the atmospheric chamber and the environment surrounding the setting tool via the groove when the piston is in the third position.

An embodiment of a tool string disposable in a wellbore comprises a downhole plug configured to seal against an inner surface of a tubular string disposed in the wellbore, and a setting tool connectable to the downhole plug, comprising a housing comprising a central passage, a piston slidably disposed in the housing and comprising a central passage a first end, and a second end configured to couple with a mandrel of the downhole plug, and wherein the piston comprises a first position in the housing and a second position the housing spaced from the first position in a first axial direction, and a piston adapter configured to releasably couple to the piston via a first internal connector of the piston adapter that is positioned on an inner surface thereof, and wherein the piston adapter comprises a second internal connector positioned on the inner surface of thereof and an external connector positioned on an outer surface thereof, wherein, in response to a pressurization of the central passage of the piston of the setting tool, the setting tool is configured to actuate the downhole plug to seal against an inner surface of a tubular string. In some embodiments, the piston adapter is configured to couple to a first shear cap of a first downhole plug adapter kit via the external connector and to couple to a second shear cap of a second frag plug adapter kit via the second internal connector. In some embodiments, the first downhole plug adapter kit has a maximum outer diameter which is greater than a maximum outer diameter of the second downhole plug adapter kit. In certain embodiments, the setting tool further comprises a cross-over comprising an internal connector configured to couple to a connector of the housing and an external connector configured to couple to a first setting sleeve of the first adapter kit. In certain embodiments, the connector of the housing is configured to releasably couple to a connector of a second setting sleeve of the second adapter kit. In some embodiments, the setting tool further comprises a mandrel coupled between the piston and the mandrel of the downhole plug, and wherein the mandrel of the setting tool is welded to the mandrel via an annular seam weld. In some embodiments, the setting tool further comprises an atmospheric chamber filled with a compressible fluid and formed around the piston. In certain embodiments, the setting tool further comprises an annular pressure chamber positioned radially between an inner surface of the housing and an outer surface of the piston, and wherein the pressure chamber is in fluid communication with the central passage of the piston via a port formed in the piston, and an annular impact ring positioned about the piston, and wherein the impact ring is positioned axially between the pressure chamber and the second end of the piston, and wherein the impact ring is configured to impact a shear cap connected to an end of the piston when the setting tool is actuated from the first position to the second position.

BRIEF DESCRIPTION OF THE DRAWINGS

For a detailed description of exemplary embodiments of the disclosure, reference will now be made to the accompanying drawings in which.

DETAILED DESCRIPTION

Figure 1:
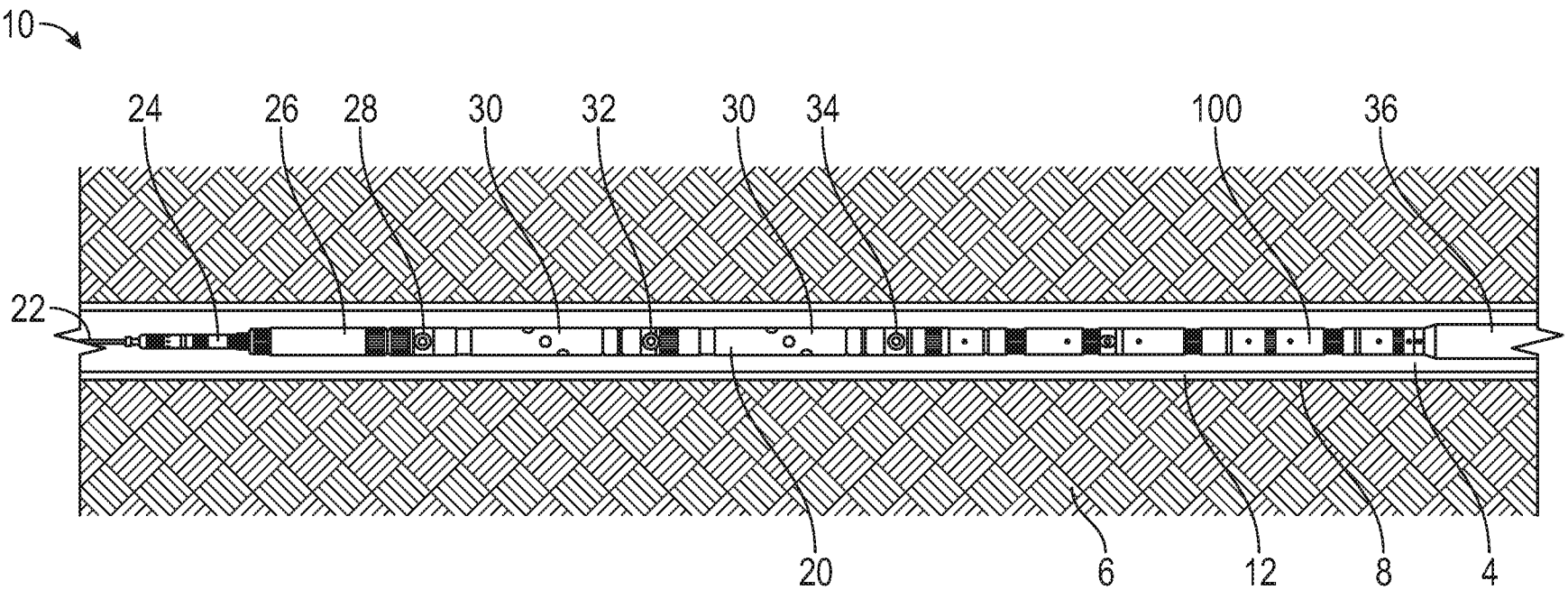
FIG. 1 is a schematic, partial cross-sectional view of a system for completing a subterranean well including an embodiment of a setting tool in accordance with the principles disclosed herein.
Figure 2:
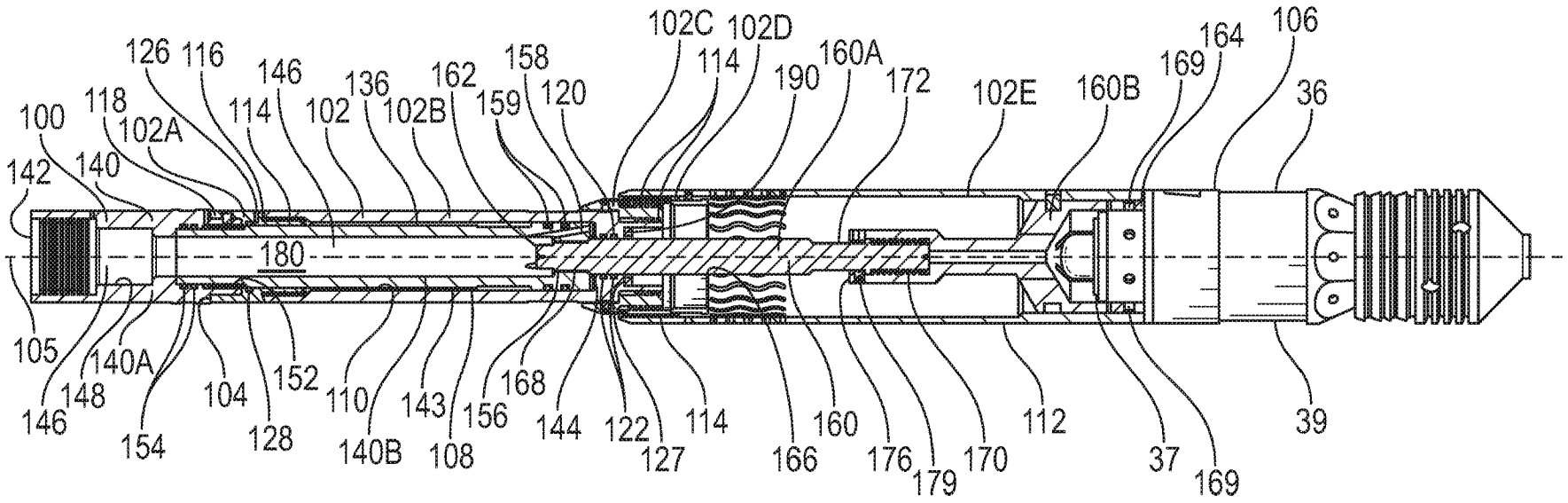
FIGS. 2-5 are side cross-sectional views of the setting tool of FIG. 1 in a run-in position in accordance with principles disclosed herein.
Figure 3:
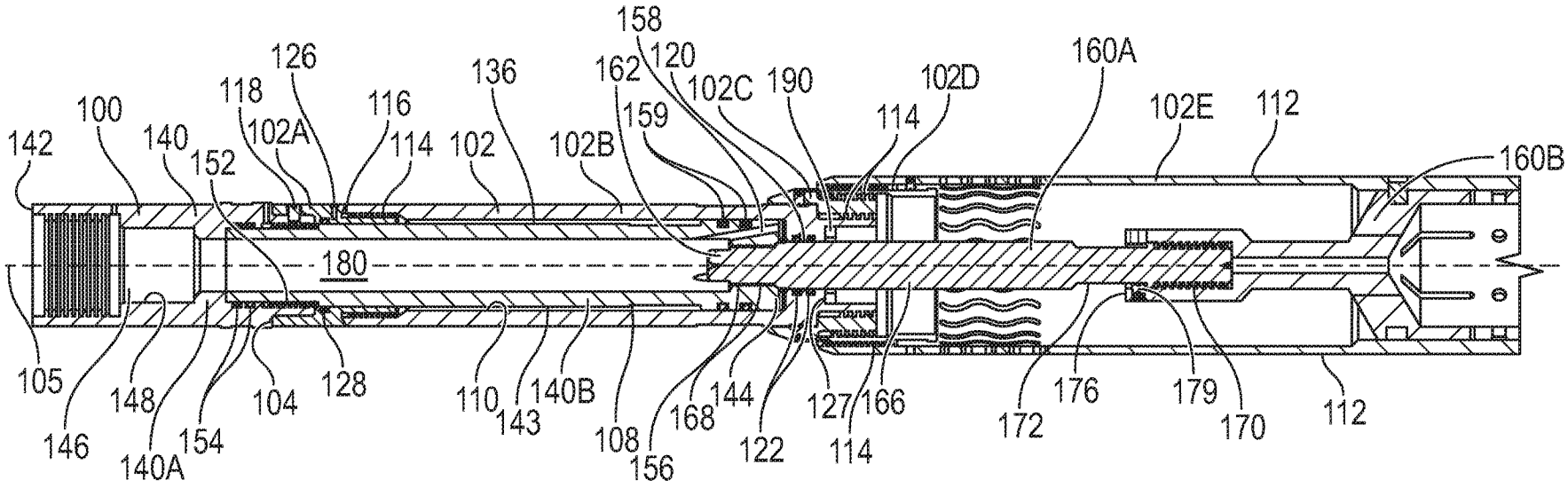

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring now to FIG. 1, a system 10 for completing a wellbore 4 extending into a subterranean formation 6 is shown. In the embodiment of FIG. 1, wellbore 4 is a cased wellbore including a casing string 12 secured to an inner surface 8 of the wellbore 4 using cement (not shown). In some embodiments, casing string 12 generally includes a plurality of tubular segments coupled together via a plurality of casing collars. In this embodiment, completion system 10 includes a tool string 20 disposed within wellbore 4 and suspended from a wireline 22 that extends to the surface of wellbore 4. Wireline 22 comprises an armored cable and includes at least one electrical conductor for transmitting power and electrical signals between tool string 20 and the surface. System 10 may further include suitable surface equipment for drilling, completing, and/or operating completion system 10 and may include, in some embodiments, derricks, structures, reels, pumps, electrical/mechanical well control components, etc. Tool string 20 is generally configured to perforate casing string 12 to provide for fluid communication between formation 6 and wellbore 4 at predetermined locations to allow for the subsequent hydraulic fracturing of formation 6 at the predetermined locations.

In this embodiment, tool string 20 generally includes a cable head 24, a casing collar locator (CCL) 26, a direct connect sub 28, a plurality of perforating guns 30, a switch sub 32, a plug-shoot firing head 34, a setting tool 100, and a downhole or frac plug 36 (shown schematically in FIG. 1). Cable head 24 is the uppermost component of tool string 20 and includes an electrical connector for providing electrical signal and power communication between the wireline 22 and the other components (CCL 26, perforating guns 30, setting tool 100, etc.) of tool string 20. CCL 26 is coupled to a lower end of the cable head 24 and is generally configured to transmit an electrical signal to the surface via wireline 22 when CCL 26 passes through a casing collar, where the transmitted signal may be recorded at the surface as a collar kick to determine the position of tool string 20 within wellbore 4 by correlating the recorded collar kick with an open hole log. The direct connect sub 28 is coupled to a lower end of CCL 26 and is generally configured to provide a connection between the CCL 26 and the portion of tool string 20 including the perforating guns 30 and associated tools, such as the setting tool 100 and downhole plug 36.

Perforating guns 30 of tool string 20 are coupled to direct connect sub 28 and are generally configured to perforate casing string 12 and provide for fluid communication between formation 6 and wellbore 4. Particularly, perforating guns 30 include a plurality of shaped charges that may be detonated by a signal conveyed by the wireline 22 to produce an explosive jet directed against casing string 12. Perforating guns 30 may be any suitable perforation gun known in the art while still complying with the principles disclosed herein. For example, in some embodiments, perforating guns 30 may comprise a hollow steel carrier (HSC) type perforating gun, a scalloped perforating gun, or a retrievable tubing gun (RTG) type perforating gun. In addition, gun 30 may comprise a wide variety of sizes such as, for example, 2¾", 3⅛", or 3⅜", wherein the above listed size designations correspond to an outer diameter of perforating guns 30.

In this embodiment, switch sub 32 of tool string 20 is coupled between the pair of perforating guns 30 and includes an electrical conductor and switch generally configured to allow for the passage of an electrical signal to the lowermost perforating gun 30 of tool string 20. Tool string 20 further includes plug-shoot firing head 34 coupled to a lower end of the lowermost perforating gun 30. Plug-shoot firing head 34 couples the perforating guns 30 of the tool string 20 to the setting tool 100 and downhole plug 36, and is generally configured to pass a signal from the wireline 22 to the setting tool 100 of tool string 20. Plug-shoot firing head 34 may also include mechanical and/or electrical components to fire the setting tool 100.

In this embodiment, tool string 20 further includes setting tool 100 and downhole plug 36, where setting tool 100 is coupled to a lower end of plug-shoot firing head 34 and is generally configured to set or install downhole plug 36 within casing string 12 to isolate desired segments of the wellbore 4, as will be discussed further herein. Once downhole plug 36 has been set by setting tool 100, an outer surface of downhole plug 36 seals against an inner surface of casing string 12 to restrict fluid communication through wellbore 4 across downhole plug 36. Downhole plug 36 of tool string 20 may be any suitable downhole or frac plug known in the art while still complying with the principles disclosed herein. Additionally, although setting tool 100 is shown in FIG. 1 as incorporated in tool string 20, setting tool 100 may be used in other tool strings comprising components differing from the components comprising tool string 20.

Referring to FIGS. 1-9, an embodiment of the setting tool 100 of the tool string 20 of FIG. 1 is shown in FIGS. 2-9. In the embodiment of FIGS. 2-9, setting tool 100 has a central or longitudinal axis 105 and generally includes an outer housing 102, a piston 140 slidably disposed at least partially in housing 102, and a mandrel 160 slidably disposed at least partially in housing 102. In some embodiments, piston 140 comprises a firing head adapter 141 (shown in FIG. 4) for coupling setting tool 100 with plug-shoot firing head 34. Housing 102 of setting tool 100 has a first end 104, a second end 106 axially spaced from first end 104, a central bore or passage 108 defined by a generally cylindrical inner surface 110 extending between ends 104, 106, and a generally cylindrical outer surface 112 extending between ends 104, 106. As shown particularly in FIG. 2, frac plug 36 (in the interest of clarity, frac plug 36 is hidden in FIGS. 3, 9) is received in central passage 108 at the lower end 106 of housing 102. In this embodiment, housing 102 comprises a plurality of tubular segments 102A-102E coupled together via releasable or threaded connectors 114; however, in other embodiments, housing 102 of setting tool 100 may comprise a single, unitary member. Additionally, an annular seal 116 is positioned radially between tubular segments 102A and 102B of housing 102 to seal the connection formed therebetween from the environment surrounding setting tool 100 (e.g., wellbore 4).

In this embodiment, housing 102 includes at least one shear pin 118 that extends radially into central passage 108 from inner surface 110 and is frangibly connected to piston 140. As will be discussed further herein, shear pin 118 restricts relative axial movement between piston 140 and housing 102 prior to the desired actuation of setting tool 100. Additionally, in this embodiment, the inner surface 110 of housing 102 includes a radially inwards extending shoulder or flange 120 located proximal second end 106. The inner surface 112 of flange 120 includes an annular seal assembly 122 comprising pair of axially spaced annular seals that sealingly engage mandrel 160 of setting tool 100. As shown particularly in FIG. 4, housing 102 also includes a metered vent orifice 124 and a radial port 125 each axially located between flange 120 and second end 106. Vent orifice 124 extends radially outwards from inner surface 110 of housing 102 and intersects radial port 125 which extends radially inwards from outer surface 112. In this embodiment, a plug 126 is positioned in radial port 125, where plug 126 restricts fluid flow from central passage of housing to the environment surrounding setting tool 100 via vent orifice 124 and radial port 125. In this embodiment, plug 126 is configured to be ejected from the radial port 125 in response to the formation of a predetermined pressure differential across plug 126.

Figure 10:
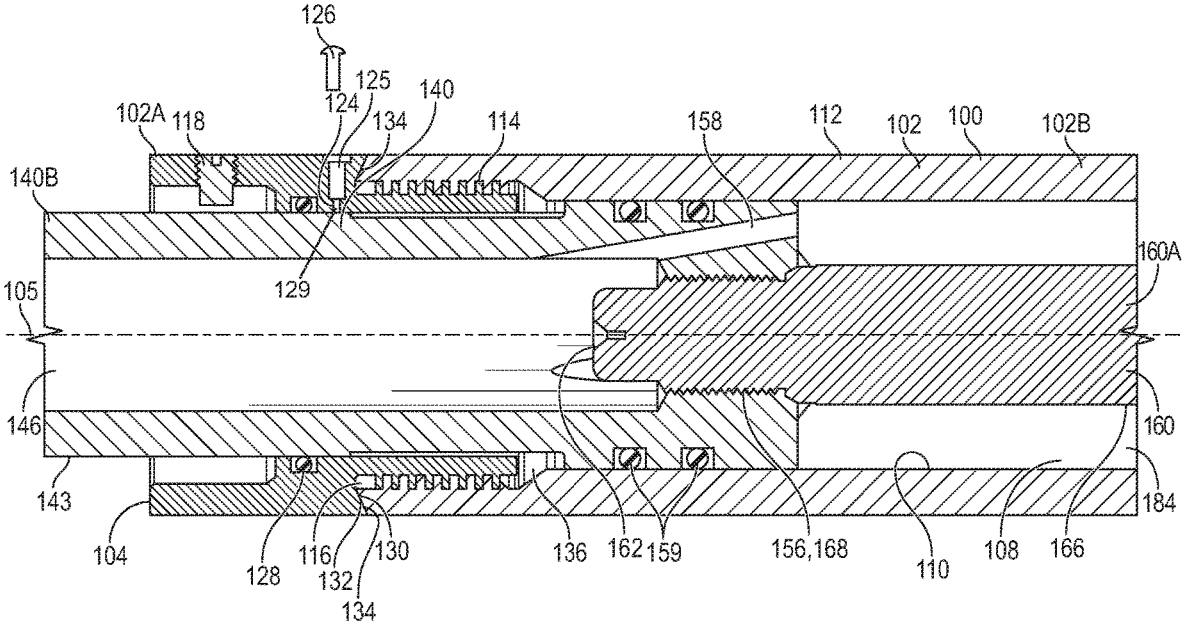
FIGS. 10, 11 are additional side cross-sectional views of the setting tool of FIG. 1 in the full-stroke position.
Figure 11:
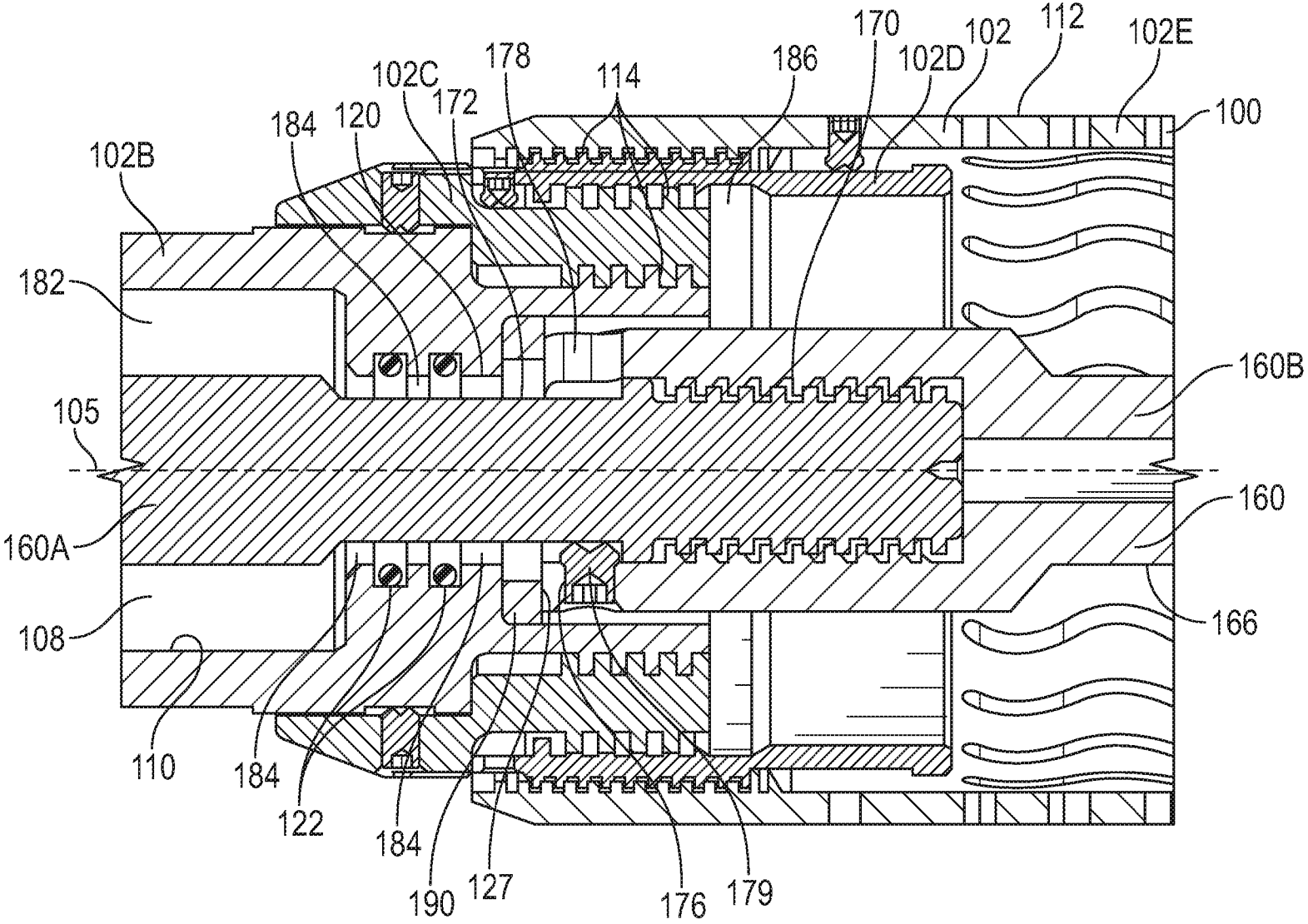
Figure 12:
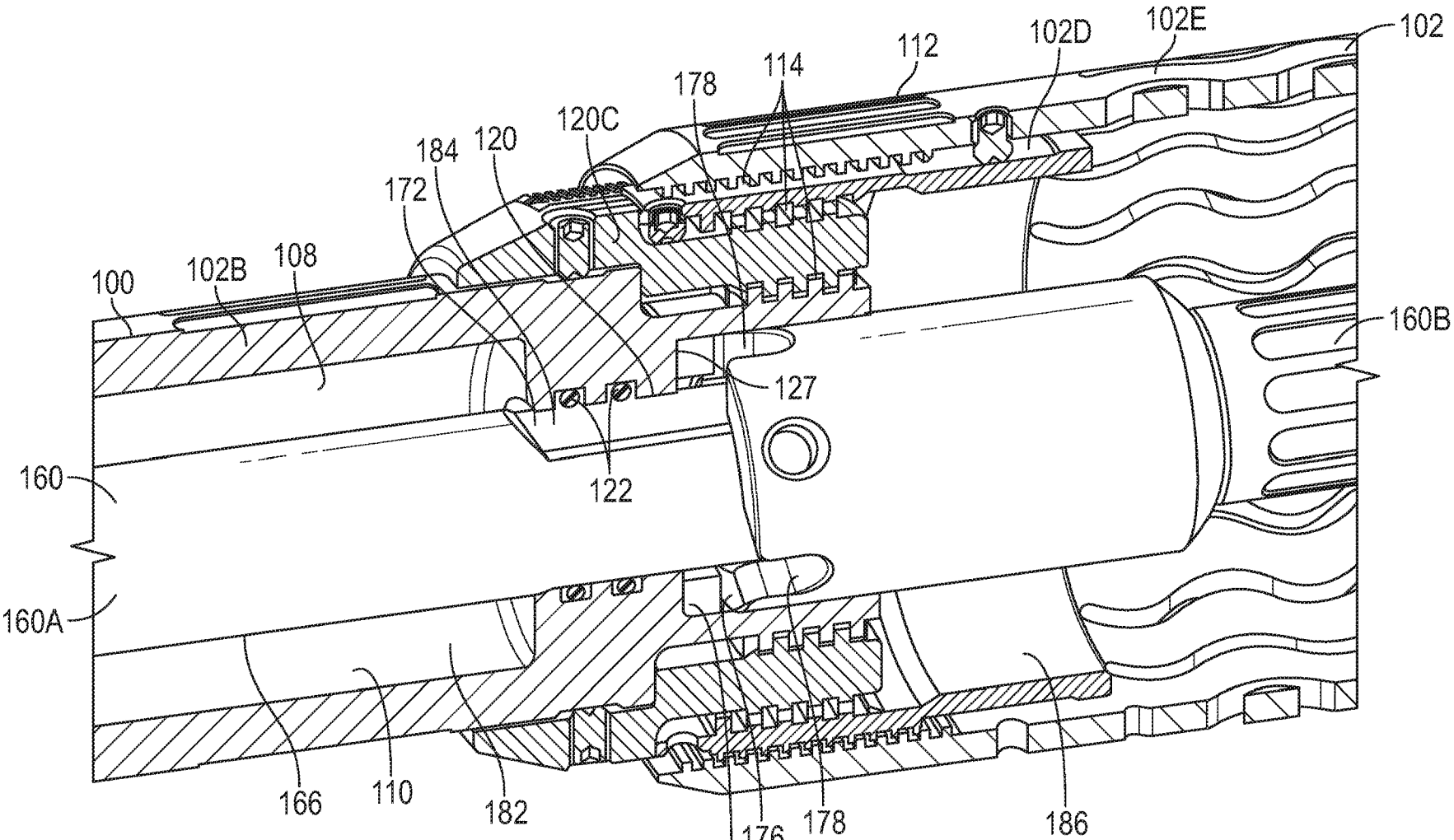
FIG. 12 is a perspective cross-sectional view of the setting tool of FIG. 1 in the full-stroke position.

As will be described further herein plug 126 is removeably positioned in vent orifice 124 such that plug 126 may be ejected from radial port 125 during the actuation of setting tool 100, thereby establishing fluid communication between at least a portion of central passage 108 of housing 102 and the environment surrounding setting tool 100. Additionally, vent orifice 124 is configured to meter fluid flow therethrough during the actuation of setting tool 100 to control the rate of relative movement between piston 140 and housing 102. Thus, vent orifice 124 comprises a fluid damper 129 (shown in FIG. 10) that dampens the actuation of setting tool 100. In this embodiment, an annular seal assembly 128 comprising a pair of annular seals is positioned in a groove formed on the inner surface 110 of the upper tubular segment 102A of housing 102, annular seal assembly 128 in sealing engagement with piston 140. In some embodiments, oil or other incompressible fluid having a predetermined or desired weight and viscosity is disposed in sealed chamber 136, the weight and viscosity of the oil being selected to assist in controlling the rate at which piston 140 strokes through housing 102.

Figure 4:
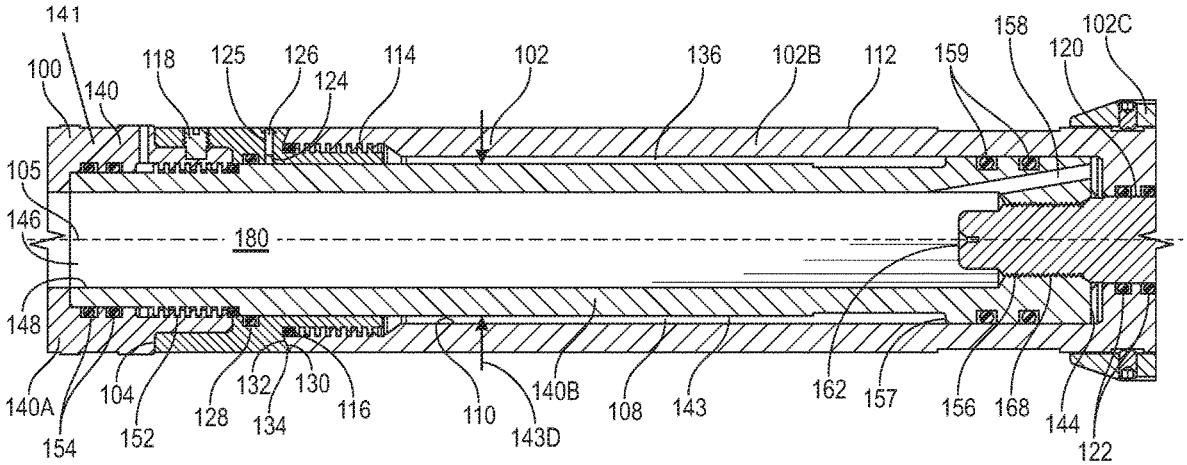

Additionally, as shown particularly in FIG. 4, upper tubular segment 102A of housing 102 includes an annular shoulder 130 and an upper end of intermediate tubular segment 102B includes an annular shoulder 132 which matingly engages the annular shoulder 130 of upper tubular segment 102A. In this embodiment, annular shoulders 130, 132 are each angled relative to longitudinal axis 105, thereby providing an angled or inclined interface 134 therebetween. Particularly, each annular shoulder 130, 132 extends radially at a non-orthogonal or non-ninety degree angle relative to the longitudinal axis 105 of setting tool 100. In this configuration, annular shoulder 132 of intermediate tubular segment 102B is disposed radially within annular shoulder 130 of upper tubular segment 102A. Due to the inclined interface 134 formed between annular shoulders 130, 132 pressurization of central passage 108 of housing 102 results in a radially directed force acting between annular shoulders 130, 132, thereby reducing the axially directed force acting between annular shoulders 130 132 in response to pressurization of central passage 108. Thus, inclined interface 134 reduces any bulging formed between annular shoulders 130 132 that may result from pressurization of the central passage 108 of housing 102, thereby permitting the formation of relatively greater pressure within central passage 108 (relative to the environment surrounding housing 102) without permitting leakage between annular shoulders 130, 132.

Piston 140 of setting tool 100 has a first end 142, a second end 144 axially spaced from first end 142, a central bore or passage 146 defined by a generally cylindrical inner surface 148 extending between ends 142, 144, and a generally cylindrical outer surface 150 extending between ends 142, 144. In this embodiment, piston 140 comprises a plurality of tubular segments 140A, 140B coupled together via a releasable or threaded connector 152; however, in other embodiments, piston 140 of setting tool 100 may comprise a single, unitary member. Additionally, a pair of annular seals 154 are positioned radially between tubular segments 140A, 140B of piston 140 to seal the connection formed therebetween from central passage 108 of housing 102 and the environment surrounding setting tool 100 (e.g., wellbore 4).

In this embodiment, the inner surface 148 of piston 140 includes a releasable or threaded connector 156 located at second end 144 for releasably connecting to a corresponding connector of mandrel 160. Although in this embodiment piston 140 and mandrel 160 comprise distinct, releasably connectable members, in other embodiments, piston 140 and mandrel 160 may comprise a single, unitary member. Additionally, the outer surface 150 of piston 140 includes an upper annular shoulder 157 (shown in FIG. 4) proximal lower end 144.

In this embodiment, piston 140 includes one or more circumferentially spaced ports 158 that extend at an angle relative to central axis 105 of setting tool 100. Particularly, each port 158 includes a first end formed at the inner surface 148 and a second end formed at the second end 144 of piston 140. In this configuration, the second end of each port 158 is disposed circumferentially about and radially spaced from central passage 146. Further, piston 140 includes an annular seal assembly 159 comprising pair of annular seals disposed on outer surface 150 and located proximal second end 144. Seal assembly 159 of piston 140 sealingly engages the inner surface 110 of housing 102. The sealing engagement provided by seal assembly 159 of piston 140 and seal assembly 128 of housing 102 forms an annular sealed chamber 136 extending axially between seal assembly 128 and seal assembly 159. Additionally, sealed chamber 136 extends radially between an annular chamber surface 143 of piston 140 and the inner surface 110 of housing 102.

Mandrel 160 of setting tool 100 has a first end 162, a second end 164 axially spaced from first end 162, and a generally cylindrical outer surface 166 extending between ends 162, 164. In this embodiment, mandrel 160 comprises a plurality of tubular segments 160A, 160B connected end-to-end; however, in other embodiments, mandrel 160 of setting tool 100 may comprise a single, unitary member. The outer surface 166 of the upper tubular segment 160A of mandrel 160 includes a first releasable or threaded connector 168 located at first end 162, and a second releasable or threaded connector 170 located at a lower end of upper tubular segment 160A. First threaded connector 168 of mandrel 160 threadably connects to the threaded connector 156 of piston 140 to thereby releasably connect piston 140 with mandrel 160. Second releasable connector 170 of mandrel 160 releasably or threadably connected upper tubular segment 160A of mandrel 160 with lower tubular segment 160B. Additionally, the lower end 164 of mandrel 160 includes a plurality of shear members or pins 169 which frangibly connect mandrel 160 with a mandrel 37 of frac plug 36 (shown in FIG. 2).

Figure 5:
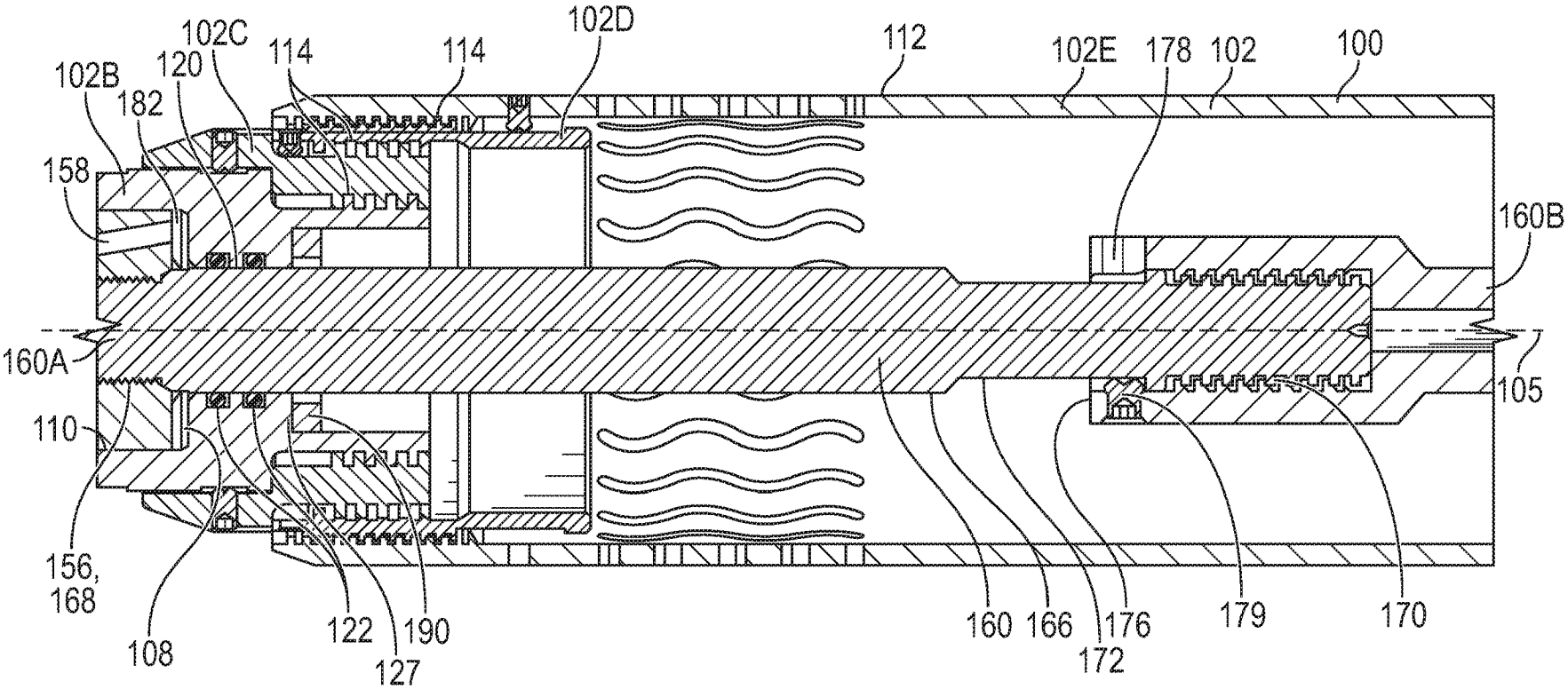
Figure 6:
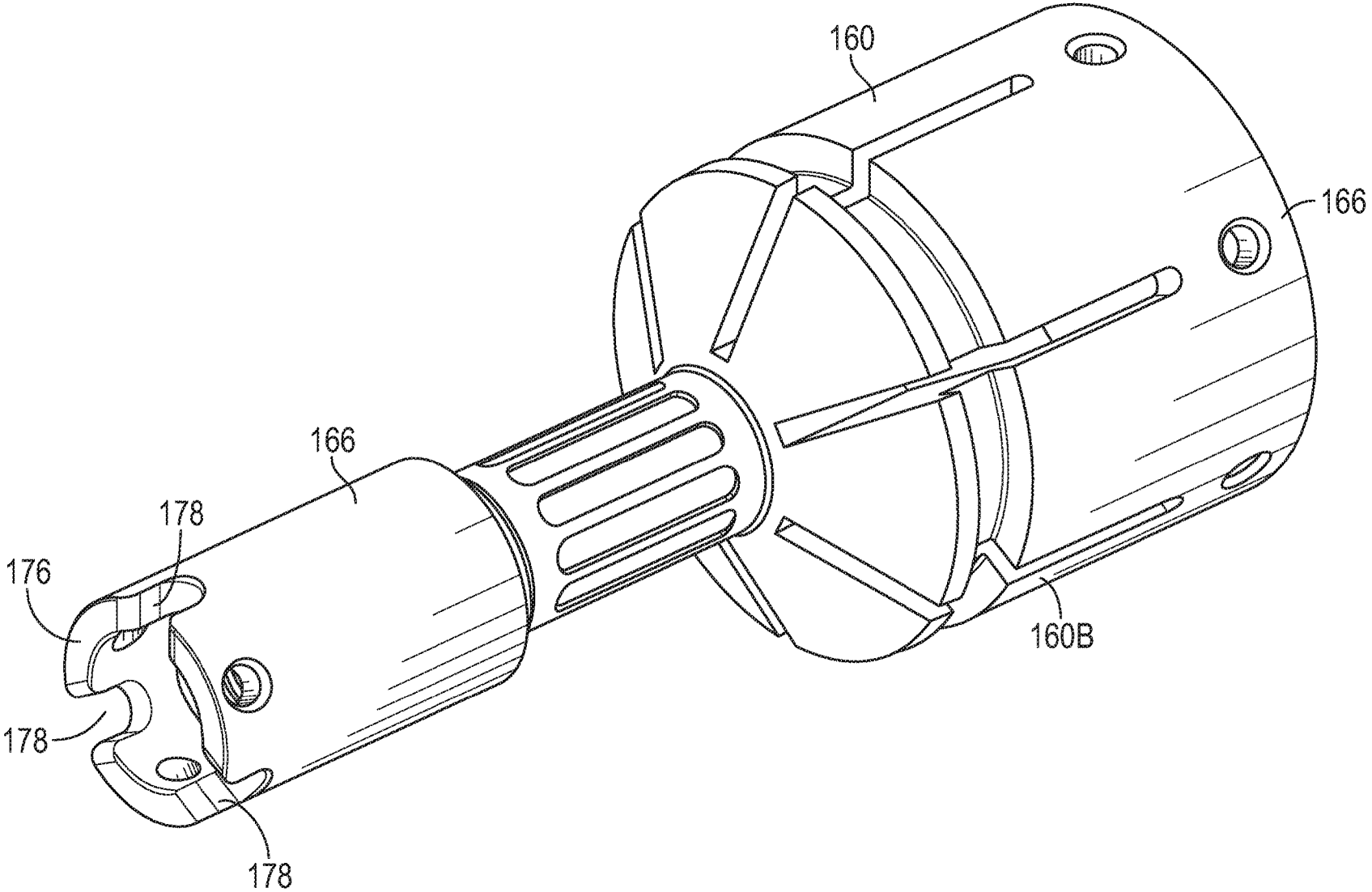
FIGS. 6, 7 are perspective views of an embodiment of a shear cap of the setting tool of FIGS. 2-5 in accordance with principles disclosed herein.

As shown particularly in FIGS. 5, 6, the outer surface 166 of mandrel 160 includes a plurality of axially aligned and circumferentially spaced planar or uncurved surfaces 172, where each planar surface 172 extends axially a distance equal to or greater than the axial spacing between the annular seals of the seal assembly 122 of housing 102. In this embodiment, the arrangement of planar surfaces 172 forms a cross-section that has a maximum width and a minimum width which is less than an inner diameter of flange 120. Although in this embodiment outer surface 166 of mandrel 160 includes planar surfaces 172, in other embodiments, outer surface 166 may comprise an annular groove having an outer diameter that is less than the inner diameter of the flange 120 of housing 102. In still other embodiments, the outer surface 166 of mandrel 160 may comprise varying geometries each providing a radial opening or gap between outer surface 166 and the inner surface of flange 120.

Figure 7:
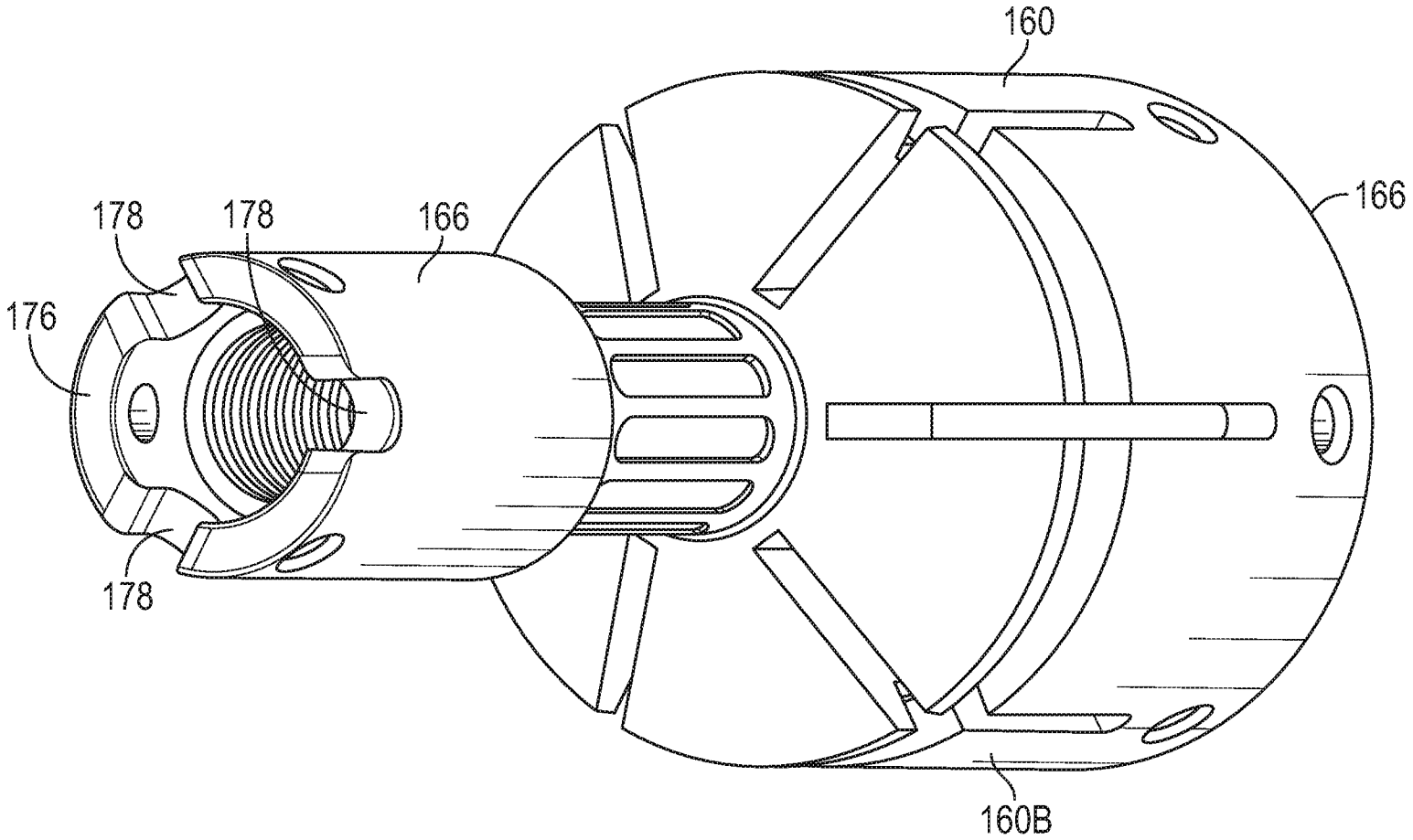
Figure 8:
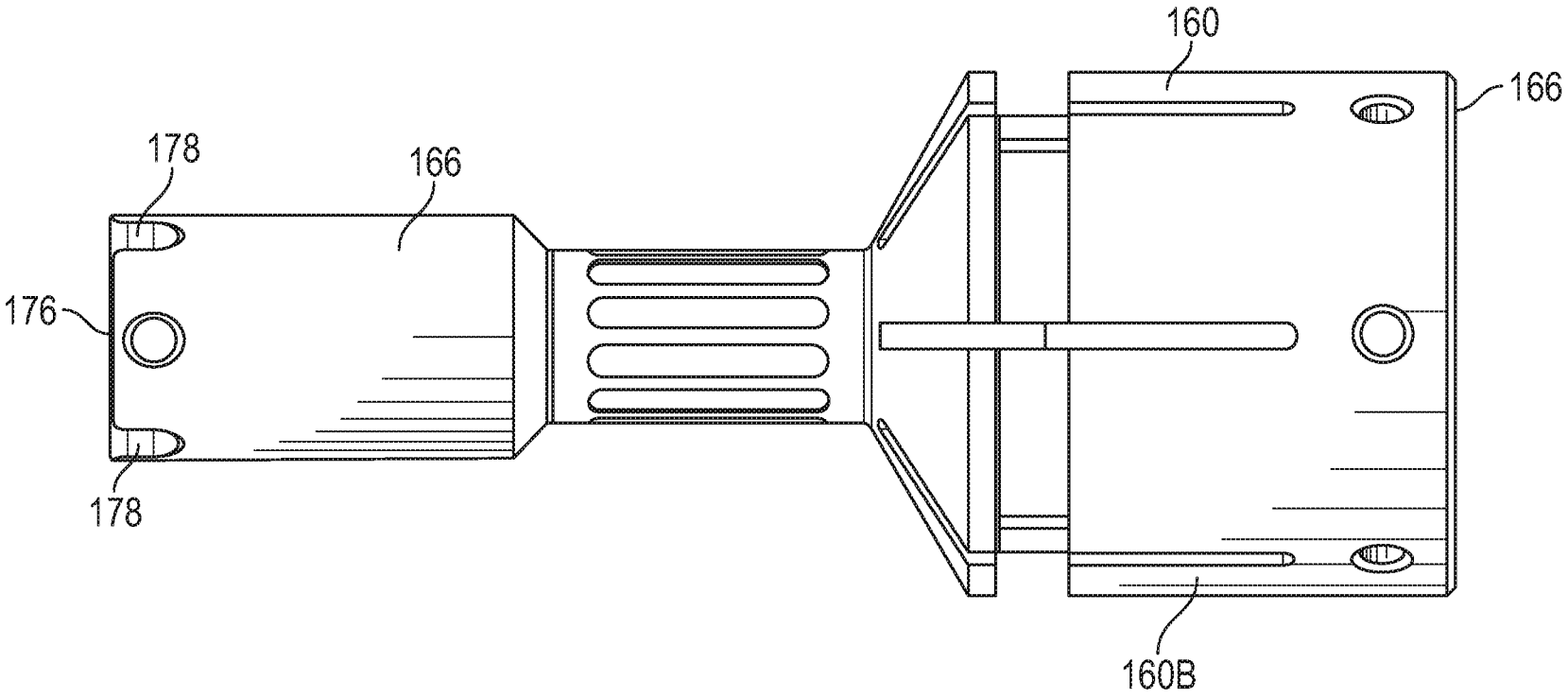
FIG. 8 is a side view of the shear cap of FIGS. 6, 7.
Figure 9:
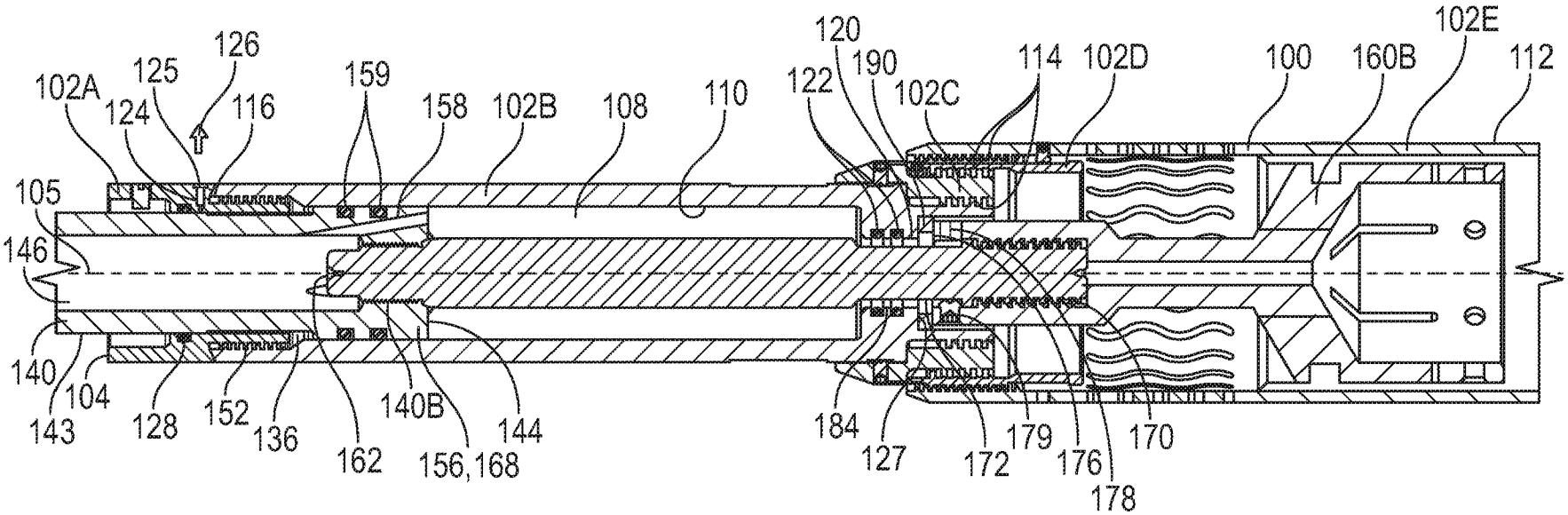
FIG. 9 is a side cross-sectional view of the setting tool of FIG. 1 in a full-stroke position.

As shown particularly in FIGS. 7-9, an upper end of the lower tubular segment 160B of mandrel 160 defines a radially outwards extending annular shoulder 176. Shoulder 176 has a larger diameter than the inner diameter 120D of the flange 120 of housing 102, thereby preventing shoulder 176 from passing through flange 120. In this embodiment, a plurality of circumferentially spaced openings or slots 178 extend axially into annular shoulder 176. Slots 178 are angularly or circumferentially aligned with planar surfaces 172. In this embodiment, a plurality of radial connectors or pins 179 extend radially between tubular segments 160A, 160B of mandrel 160 to ensure that relative rotation is restricted between tubular segments 160A, 160B.

In this embodiment, setting tool 100 includes an annular impact member or ring 190 that is positioned directly adjacent a lower annular shoulder 127 formed by the flange 120 of housing 102 and surrounds mandrel 160. Impact ring 190 is formed from or comprises a relatively soft material such as plastic, rubber, including poly or polyurethane rubber, or a soft metal (e.g., brass, etc.) configured for absorbing energy imparted to impact ring 190 from an impact with mandrel 160, as will be described further herein. In this configuration, the material from which impact ring 190 has a lesser hardness and/or greater elasticity than the material from which housing 102 and/or mandrel 160 are comprised. In some embodiments, impact ring 190 may be reusable and permanently attached to housing 102; however, in other embodiments, impact ring 190 may be removable from housing 102 such that impact ring 190 may be replaced following an actuation of setting tool 100.

Referring again to FIGS. 1-12, as described above, setting tool 100 is pumped downhole though wellbore 4 along with the other components of tool string 20. As tool string 20 is pumped through wellbore 4, the position of tool string 20 in wellbore 4 is monitored at the surface via signals generated from CCL 26 and transmitted to the surface using wireline 22. Once tool string 20 is disposed in a desired location in wellbore 4, setting tool 100 may be fired or actuated from a first or run-in position of setting tool 100 shown in FIGS. 2-5 to a second or full-stroke position of setting tool 100 shown in FIGS. 9-12 to thereby set the downhole plug 36 of tool string 20, and one or more of perforating guns 30 may subsequently be fired to perforate casing 12 at the desired location.

Particularly, when setting tool 100 is run through wellbore 4 along with tool string 20, mandrel 160 of setting tool 100 is connected to mandrel 37 of downhole plug 36 via shear pins 169. In this arrangement, relative axial movement between mandrel 160 and housing 102 of setting tool 100 may provide relative axial movement between mandrel 37 and an outer housing 38 of downhole plug 36 to thereby set downhole plug 36 whereby downhole plug 36 seals against an inner surface of casing string 12. Once tool string 20 is disposed in a predetermined or desired position in wellbore 4, setting tool 100 may be set or actuated by igniting a power charge 180 (shown schematically in FIGS. 2-4) disposed in central passage 146 of piston 140. In some embodiments, power charge 180 is positioned proximal an ignitor (not shown) that is in signal communication with wireline 22. In some embodiments, the ignitor may be disposed in plug-shoot firing head 34; however, in other embodiments, it may be disposed in setting tool 100. In this manner, a firing signal may be communicated to the ignitor disposed in setting tool 100 from the surface of wellbore 4 via wireline 22 to ignite power charge 180.

Fluid (e.g., gas) pressure begins to build in the central passage 146 of piston 140 following the ignition of power charge 180, the fluid pressure in passage 146 being communicated to an annular first or pressure chamber 182 (shown in FIG. 11) disposed about mandrel 160 and extending axially between seal assembly 159 of piston 140 and the seal assembly 122 of flange 120. Fluid pressure building in pressure chamber 182 acts against the second end 144 of piston 140, applying an axially directed upward force (e.g., in the direction of plug-shoot firing head 34) against piston 140. As shown particularly in FIGS. 9-12, the axially directed force applied against piston 140 from fluid pressure in pressure chamber 182 shears the shear pin 118, allowing piston 140 and mandrel 10 to travel or stroke upwards in the direction of plug-shoot firing head 34. As mandrel 160 strokes upwardly in concert with piston 140, mandrel 160 actuates or pulls the mandrel of downhole plug 36, thereby displacing the mandrel of downhole plug 36 relative to the outer housing of plug 36.

The volume of sealed chamber 136 reduces as mandrel 160 strokes upwardly relative to housing 102, forcing the oil disposed in sealed chamber 136 through vent orifice 124 and ejecting plug 126 from radial port 125 so that the oil flowing through vent orifice 124 may vent to the environment surrounding housing 102. Mandrel 160 continues to stroke upwardly through the central passage 108 of housing 102 until the annular shoulder 176 of mandrel 160 contacts or impacts impact ring 190, thereby arresting the relative axial motion between mandrel 160 and housing 102 with setting tool 100 disposed in the full-stroke position.

The vent orifice 124 of housing 102 is configured or sized to control the rate at which fluid may flow through vent orifice 124 and thus the rate at which mandrel 160 strokes upwards through housing 102 such that the relative velocity between mandrel 160 and housing 102 does not exceed a predetermined or desired rate beyond which damage may occur to one or more components of setting tool 100 following the impact between annular shoulder 176 of mandrel 160 and impact ring 190. Particularly, vent orifice 124 has a width or diameter configured to meter or limit the rate of flow of oil disposed in sealed chamber 136 through vent orifice 124, thereby limiting the rate of upward travel of piston 140 and mandrel 160 relative to housing 102. In this embodiment, a ratio of the surface area of vent orifice 124 (defined by an inner surface of vent orifice 124) and an axially-projected surface area of piston 140 (defined by an outer diameter 143D (shown in FIG. 4) of chamber surface 143 of piston 140) is between about 0.05% and 0.95%; however, in other embodiments, the ratio of the surface area of vent orifice 124 and the surface area of piston 140 may vary.

As described above, the fluid damping provided by vent orifice 124 protects the components of setting tool 100 from damage due to excessive or an undesirably high stroke rate of piston 140 and mandrel 160 relative to housing 102. Additionally, impact ring 190 is configured to reduce the impact energy imparted to housing 102, mandrel 160, and/or piston 140 following the impact between the annular shoulder 176 of mandrel 160 and impact ring 190, thereby reducing the likelihood of damage occurring to components of setting tool 100 following the actuation of setting tool 100 to the full-stroke position.

Particularly, in conventional setting tools the upper annular shoulder of the piston impacts an annular shoulder of the outer housing of the setting tool to arrest the relative movement between the piston and housing, where the contacting shoulders of the piston and housing have relatively small surface areas, producing relatively high stresses at the contacting shoulders. However, in some embodiments, an annular surface of impact ring 190 and the annular shoulder 176 of mandrel 160 define the contacting shoulders which arrest relative movement between piston 140, mandrel 160 and housing 102, and the surface areas of the annular surface of impact ring 190 and annular shoulder 176 are relatively larger than the surface areas of upper shoulder 157 of piston 140 and a lower end of the tubular segment 102A of housing 102, which, without the action of impact ring 190, would otherwise comprise the contacting shoulders that arrest the relative movement between piston 140, mandrel 160 and housing 102. Thus, in at least some embodiments, the additional surface area provided by impact ring 190 and upper shoulder 176 of mandrel 160 reduces the contact stresses resulting between the impact therebetween.

Additionally, impact ring 190, which comprises a relatively soft, impact energy absorbing material, dampens or reduces the amount of shock or impact energy transmitted from impact ring 190 to housing 102, mandrel 160, and/or piston 140 following the impact between impact ring 190 and upper shoulder 175 of mandrel 160. Although in this embodiment impact ring 190 comprises a ring shaped member, in other embodiments, impact ring 190 may comprise varying geometries. Additionally, while in this embodiment setting tool 100 includes both vent orifice 124 and impact ring 190, in other embodiments, setting tool 100 may only include one of vent orifice 124 and impact ring 190.

Additionally, as fluid pressure in pressure chamber 182 continues to force piston 140 and mandrel 160 axially upwards, causing the section of outer surface 166 of mandrel 160 comprising planar surfaces 172 to pass and enter into axial alignment with flange 120 of the housing 102 of setting tool 100. As shown particularly in FIG. 11, in this embodiment, a plurality of arcuate gaps or openings 184 are formed between planar surfaces 172 of mandrel 160 and the inner surface 110 of flange 120. Thus, fluid pressure in pressure chamber 182 created by the ignition of power charge 180 is permitted to vent to an annular second or vent chamber 186 via the arcuate openings 184 along a fluid flowpath, where vent chamber 186 is disposed about mandrel 160 and extending axially between seal assembly 122 of flange 120 and the second end 106 of housing 102. The flowpath of fluid flowing into and through vent chamber 186 from pressure chamber 182 extends through one or more of the slots 178 formed in mandrel 160, and thus, slots 178 permit or assist with fluid flow from pressure chamber 182 to vent chamber 186.

Although in this embodiment openings 184 are formed via planar surfaces 184 of mandrel 160, in other embodiments, one or more openings may be formed between mandrel 160 and flange 120 via other features located on the outer surface 166 of mandrel 160, such as axially extending grooves formed in the outer surface 166 of mandrel 160, a section of outer surface 166 having a circumferentially extending reduced diameter or width, or other features permitting fluid flow across seal assembly 122.

Referring to FIGS. 13-18, another embodiment of a setting tool 200 is shown therein. In some embodiments, setting tool 200 may be used in tool string 20 in lieu of setting tool 100 shown in FIGS. 2-12. In the embodiment of FIGS. 13-18, setting tool 200 has a central or longitudinal axis 205 and includes a piston 210 coupled to a mandrel 240. Setting tool 200 includes additional features, such as a tubular housing, which are not shown in FIGS. 13-18 in the interest of clarity. In this embodiment, setting tool 200 includes features in common with setting tool 100 shown in FIGS. 2-12, and thus, shared features are labeled similarly. However, in other embodiments, setting tool 200 may differ in configuration from setting tool 100.

In the interest of clarity, additional components (e.g., housing 102) of setting tool 200 are omitted from FIGS. 13-18. In this embodiment, piston 210 of setting tool 200 has a first end 212, a second end 214 axially spaced from first end 212, a central bore or passage 216 defined by a generally cylindrical inner surface 218 extending between ends 212, 214, and a generally cylindrical outer surface 220 extending between ends 212, 214. Mandrel 240 of setting tool 200 has a first end 242, a second end 244 axially spaced from first end 242, and a generally cylindrical outer surface 246 extending between ends 242, 244.

Figure 13:
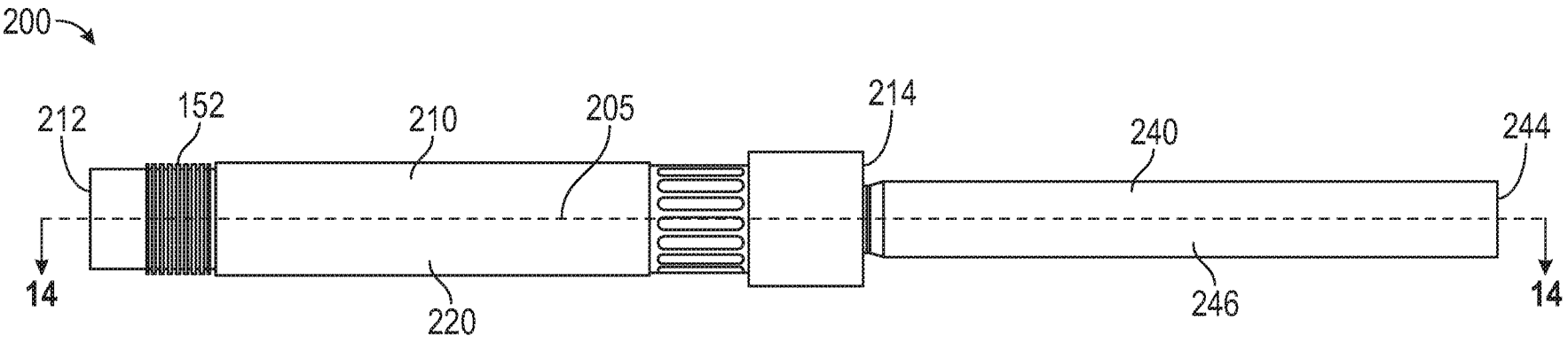
FIG. 13 is a side view of another embodiment of a setting tool in a pre-machined configuration in accordance with principles disclosed herein.
Figure 14:
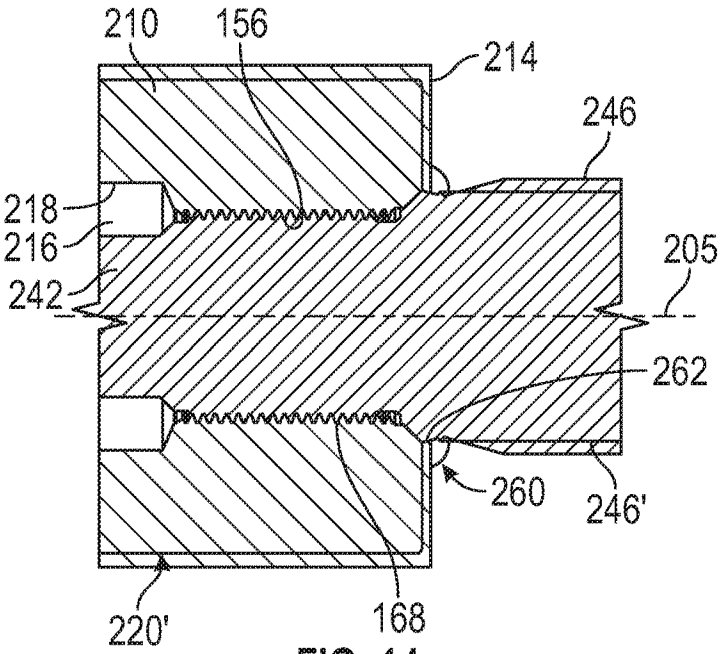
FIG. 14 is a cross-sectional view along line 14-14 of FIG. 13 of the setting tool of FIG. 13.
Figure 15:
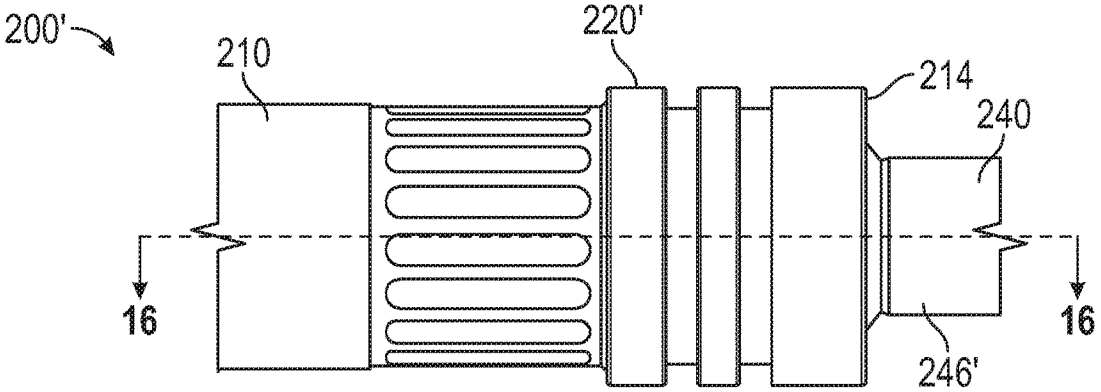
FIG. 15 is a partial side view of the setting tool of FIG. 13 in a post-machined configuration in accordance with principles disclosed herein.
Figure 16:
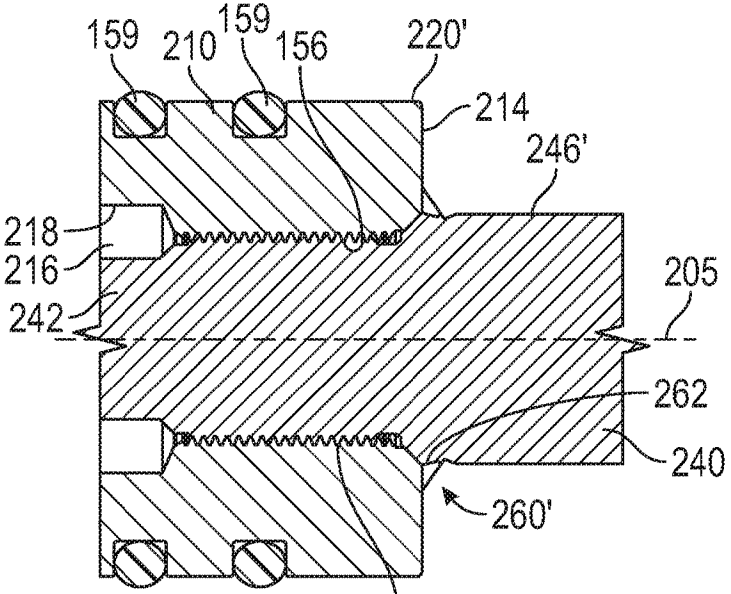
FIG. 16 is a cross-sectional view along line 16-16 of FIG. 15 of the setting tool of FIG. 15.
Figure 17:
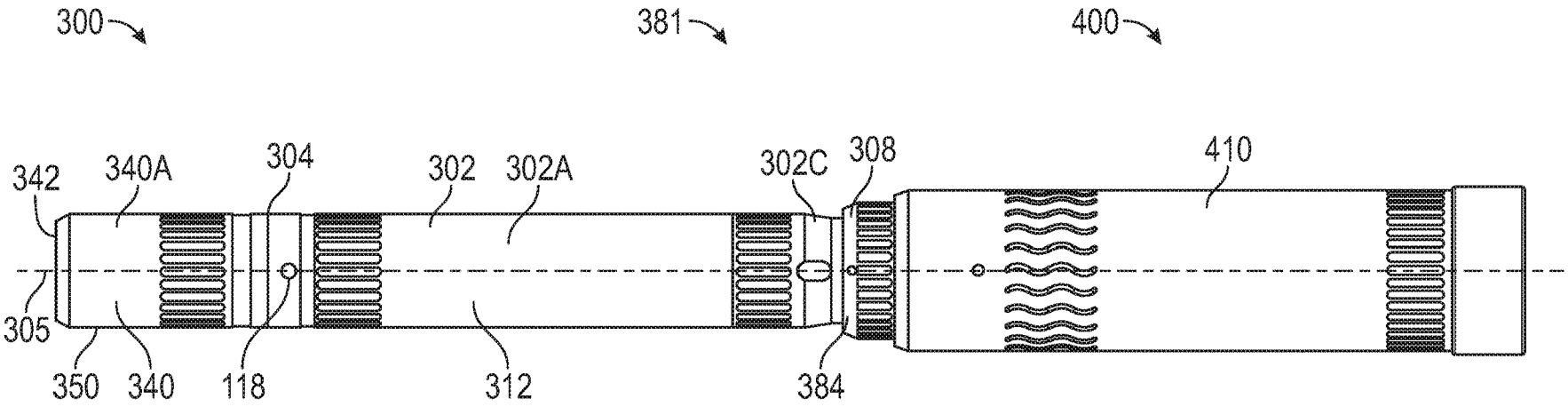
FIG. 17 is a side view of another embodiment of a setting tool in accordance with principles disclosed herein.
Figure 18:
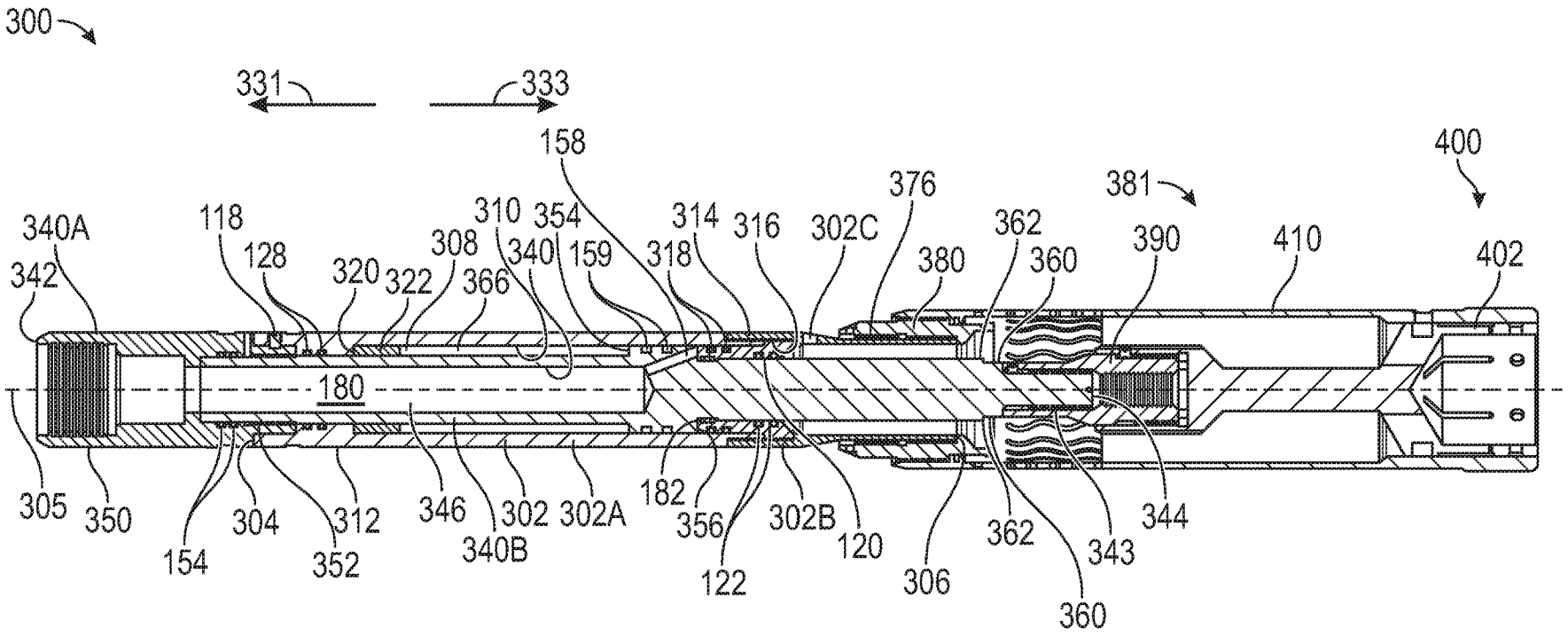
FIG. 18 is a side cross-sectional view of the setting tool of FIG. 17 in a first position in accordance with principles disclosed herein.
Figure 19:
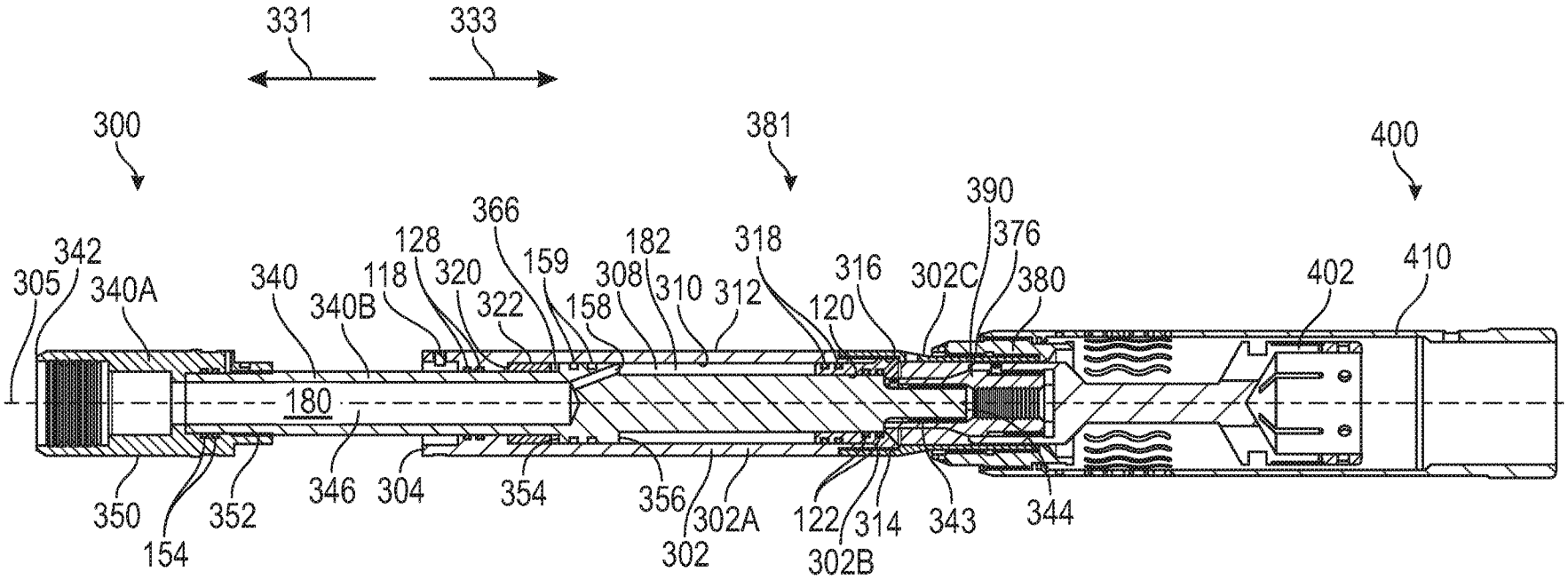
FIG. 19 is a side cross-sectional view of the setting tool of FIG. 17 in a second position in accordance with principles disclosed herein.
Figure 20:
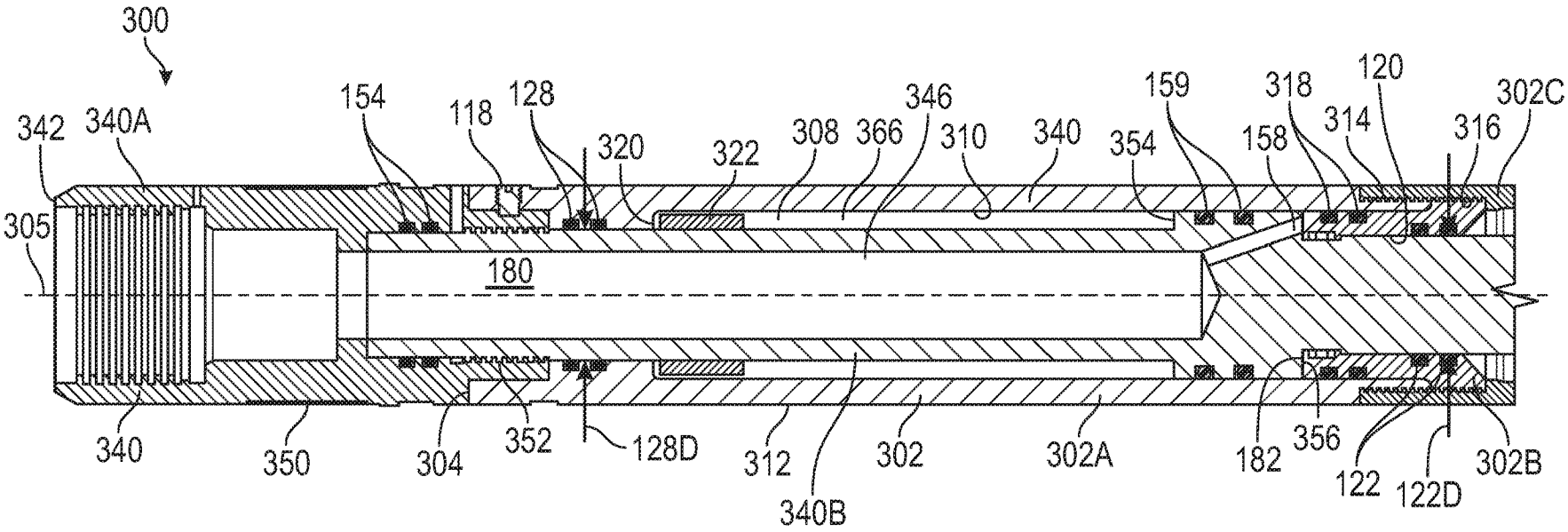
FIGS. 20, 21 are zoomed-in, side cross-sectional view of the setting tool of FIG. 17 in the first position.

FIGS. 13, 14 and FIGS. 15, 16 illustrate setting tool 200 in two different stages or configurations of assembly. Particularly, FIGS. 13, 14 illustrate setting tool 200 following the coupling of piston 210 with mandrel 240 but prior to machining of piston 210 and mandrel 240. Thus, FIGS. 13, 14 illustrate setting tool 200 in a pre-machined configuration in which piston 210 is formed from a piston blank with threaded connector 156 formed at lower end 214, and mandrel 240 is formed from a mandrel blank with first threaded connector 168 formed near upper end 242. FIGS. 15, 16 illustrate setting tool 200 in a post-machined configuration (indicated as setting tool 200' in FIGS. 15, 16) following the final machining of piston 210 and mandrel 240.

In this embodiment, piston 210 and mandrel 240 of setting tool 200 may be assembled by first rotatably or threadably connecting the threaded connector 156 of piston 210 with the first threaded connector 168 of mandrel 240. With piston 210 threadably connected to mandrel 240, an external seam 260 may be welded at an annular interface 262 formed between piston 210 and mandrel 240 proximal threaded connectors 156, 168. Seam weld 260 locks piston 210 with mandrel 240 such that the first threaded connector 168 may not inadvertently unthread or decouple from threaded connector 156 of piston 210.

In this embodiment, following the welding of piston 210 with mandrel 200, final machining may be performed on piston 210 and mandrel 200 of setting tool 200 to form the post-machined setting tool 200' shown in FIGS. 15, 16. Particularly, the outer surface 220 of piston 210 is machined to form machined outer surface 220' (shown in FIG. 16, and shown in outline in FIG. 14) and the outer surface 246 of mandrel 240 is machined to form machined outer surface 246' (shown in FIG. 16, and shown in outline in FIG. 14). Annular seals may be positioned about grooves formed on the machined outer surface 220' of piston 210 to form seal assembly 159. Additionally, in this embodiment, to form post-machined setting tool 200', seam weld 260 is machined to form a machined seam weld 260' shown in FIG. 16.

The annular seam weld 260 used to lock piston 210 with mandrel 240 of setting tool 200 provides a secure, high strength, and permanent coupling or connection between piston 210 and mandrel 240 while allowing piston 210 and mandrel 240 to be assembled from two components instead of a single, monolithic or integral component, thereby minimizing the cost of forming piston 210 and mandrel 240. Particularly, in at least some embodiments, the ability to form piston 210 and mandrel 240 from a pair of components instead of a single, monolithic component reduces the amount of machining required to form machined outer surfaces 220' and 264' of piston 210 and mandrel 240, respectively.

For example, due to the difference in diameter between machined outer surfaces 220' and 264' of piston 210 and mandrel 240, respectively, forming piston 210 and mandrel 240 from a single component (e.g., a single cylindrical blank) may require additional machining of the outer surface 264 of mandrel 240 to provide the desired diameter for machined outer surface 264'. The reduction in required machining obtained in this embodiment provides a significant cost advantage both in material costs (e.g., reducing the amount of wasted material that is removed from piston 210 and mandrel 240 during machining) and in labor cost reductions associated with reducing the time required for machining piston 210 and mandrel 240.

Referring to FIGS. 17-20, another embodiment of a setting tool 300 is shown therein. In some embodiments, setting tool 300 may be used in tool string 20 in lieu of setting tool 100 shown in FIGS. 2-12. In the embodiment of FIGS. 17-20, setting tool 300 includes features in common with setting tool 100 shown in FIGS. 2-12, and thus, shared features are labeled similarly. However, in other embodiments, setting tool 300 may differ in configuration from setting tool 100.

Setting tool 300 generally includes an outer housing 302 and a piston 340 slidably disposed in housing 302. Housing 302 of setting tool 300 has a first end 304, a second end 306 axially spaced from first end 304, a central bore or passage 308 defined by a generally cylindrical inner surface 310 extending between ends 304, 306, and a generally cylindrical outer surface 312 extending between ends 304, 306. As shown particularly in FIG. 18, in this embodiment, housing 302 comprises a plurality of tubular segments 302A-302C coupled together via releasable or threaded external connectors 314, 316; however, in other embodiments, housings 302B and 302C of setting tool 300 may comprise a single, unitary member.

Particularly, tubular segment 302A includes an external connector 314 positioned on the outer surface 312 thereof which releasably couples to an internal connector 316 of tubular segment 302C positioned on the inner surface 310 of tubular segment 302C. Additionally, tubular segment 302B includes an external connector 314 positioned on the outer surface 312 thereof which also releasably couples to connector 316 of tubular segment 302C. Further, a pair of annular outer seals 318 are positioned on the outer surface 312 of tubular segment 302C which sealingly engages the inner surface 310 of tubular segment 302A. In this embodiment, an annular internal shoulder 320 is formed on the inner surface 310 of housing 302 and an annular impact ring or member 322 is positioned adjacent internal shoulder 320. Impact ring 322 is configured similarly as impact ring 190 shown in FIG. 3, 5, and thus is configured for absorbing shock or impact energy imparted to impact ring 320 from impact with piston 340. Additionally, although in this embodiment impact ring 322 is positioned adjacent internal shoulder 320, in other embodiments, impact ring 322 may be positioned adjacent a lower end of tubular segment 302B in a similar manner as impact ring 190 shown in FIGS. 3, 5.

Piston 340 of setting tool 300 has a first end 342, a second end 344 opposite first end 342, a central bore or passage 346 defined by a generally cylindrical inner surface 148 extending between ends 342, 344, and a generally cylindrical outer surface 350 extending between ends 342, 344. As shown particularly in FIG. 18, in this embodiment, piston 340 comprises a plurality of tubular segments 340A, 340B coupled together via a releasable or threaded connector 352; however, in other embodiments, piston 340 of setting tool 300 may comprise a single, unitary member. Central passage 346 of piston 340 only extends partially from first end 342 towards second end 344 and the second end 344 of piston 340 is configured to releasably or threadably connect to a shear cap 402 of a first downhole or frac plug adapter kit 400 configured to interface setting tool 300 with a frac plug (e.g., frac plug 36 shown in FIG. 1), as will be discussed further herein.

Figure 22:
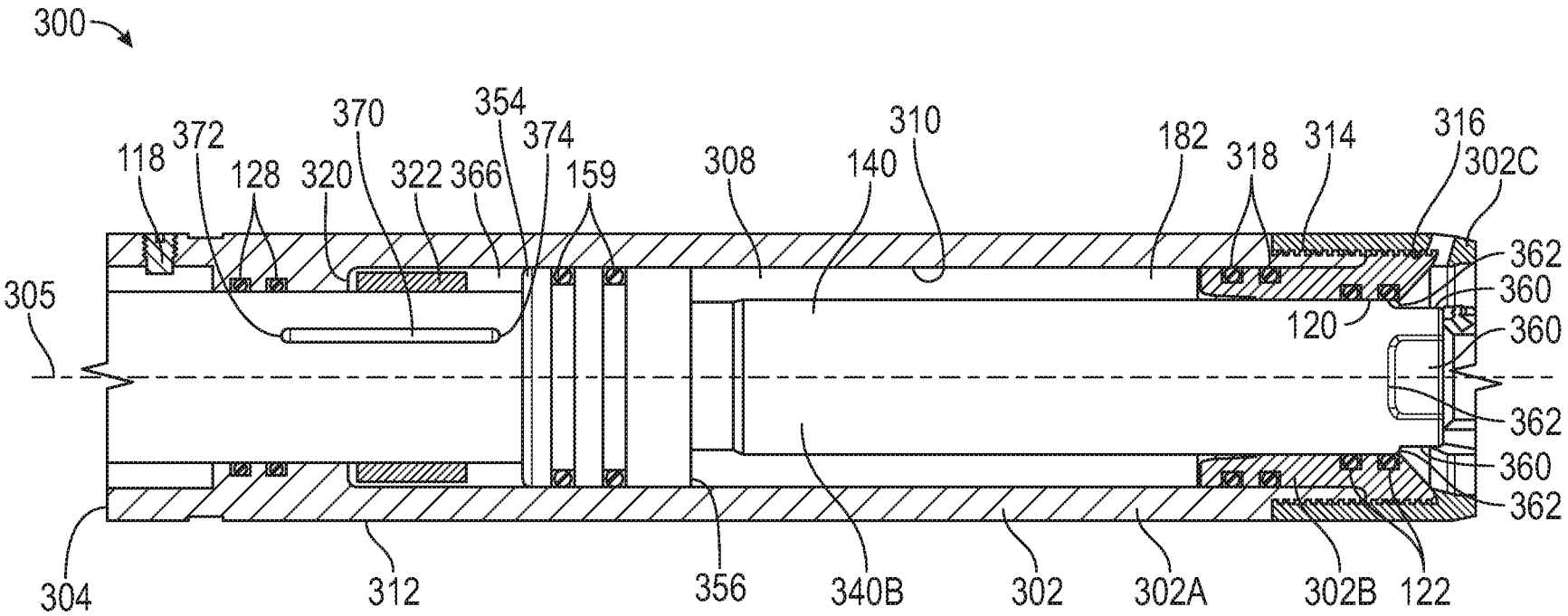
FIG. 22 is a zoomed-in, side cross-sectional view of the setting tool of FIG. 17 in a third position in accordance with principles disclosed herein.
Figure 23:
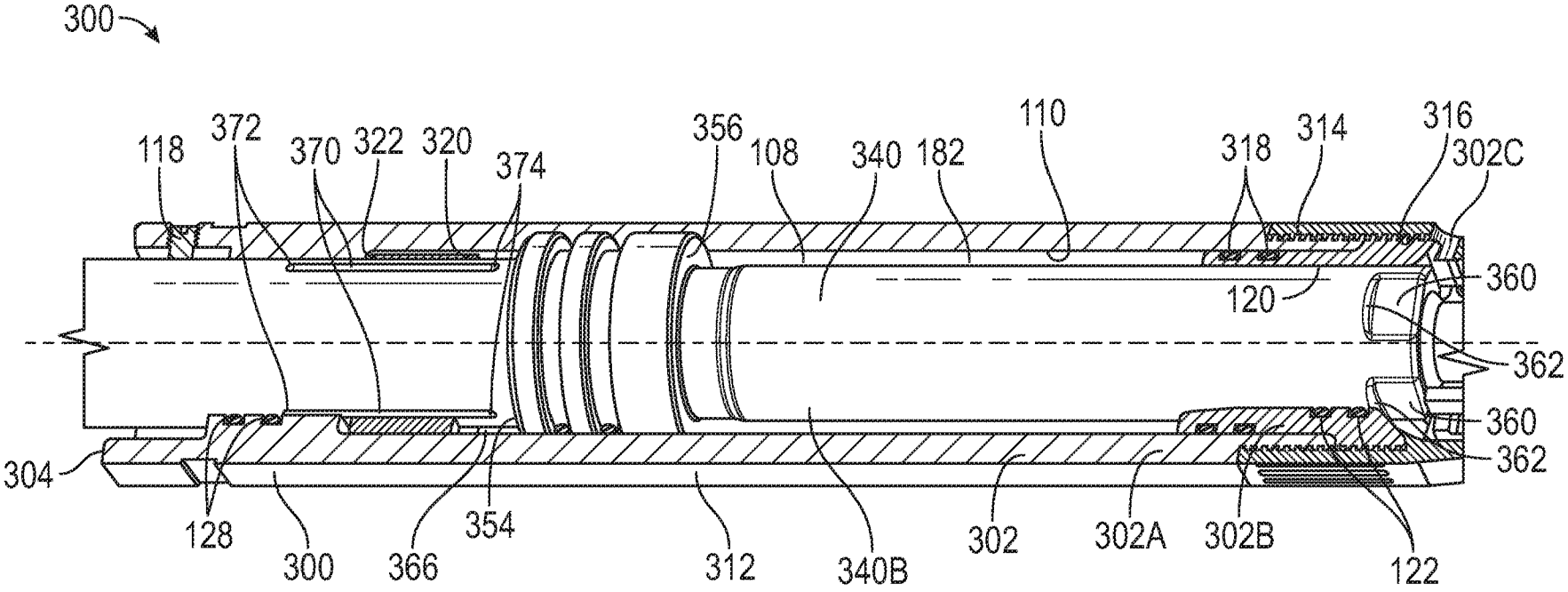
FIG. 23 is a zoomed-in, perspective cross-sectional view of the setting tool of FIG. 17 in the third position.
Figure 24:
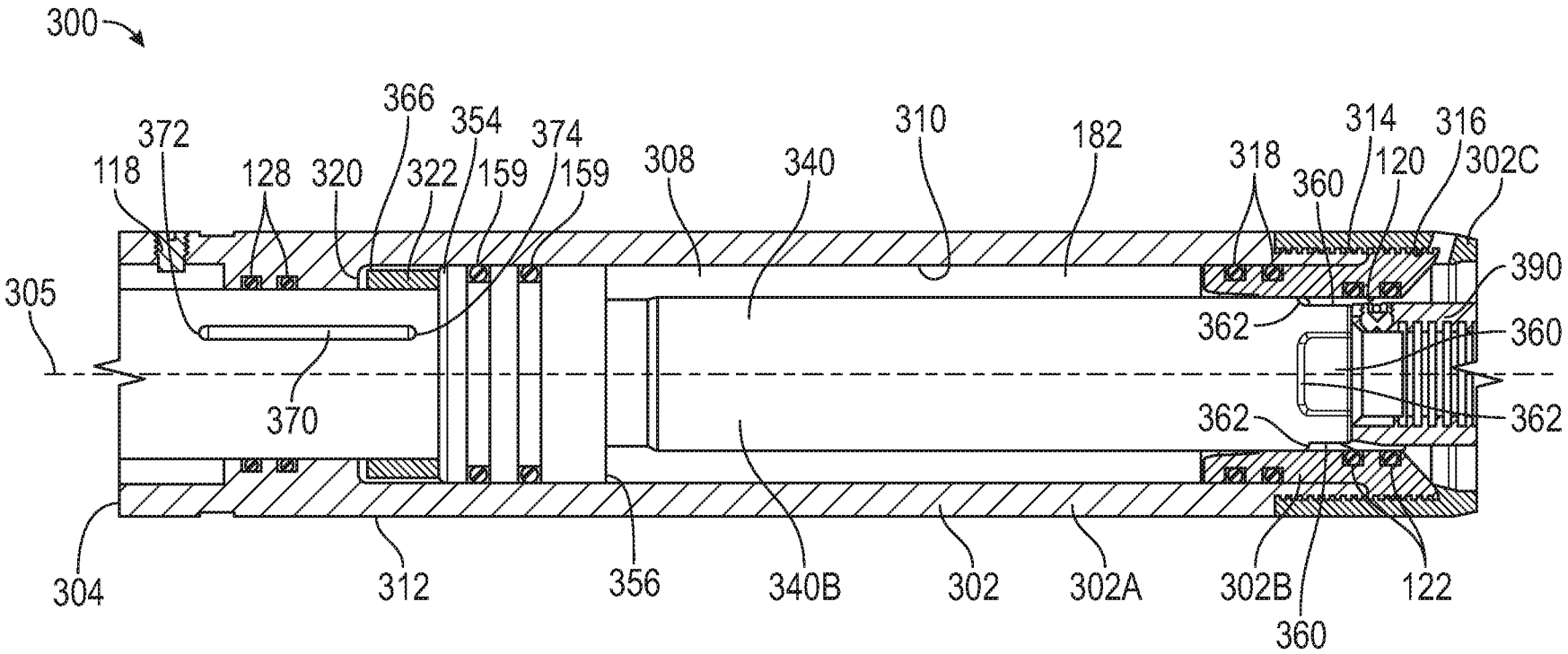
FIG. 24 is a zoomed-in, side cross-sectional view of the setting tool of FIG. 17 in the second position.

As shown particularly in FIGS. 22-24, in this embodiment, the outer surface 350 of piston 340 includes a plurality of circumferentially spaced recesses 360, each recess 360 defining an outer radius (extending from central axis 305) that is less than a radius defined by the portion of outer surface 350 extending axially between second shoulder 356 and recesses 360. In other words, each recess 360 extends into outer surface 350 to provide a reduced diameter or radius portion of outer surface 350. In this embodiment, each recess 360 comprises a planar surface; however, in other embodiments, the geometry of each recess 360 may vary. Additionally, in this embodiment, piston 340 comprises four recesses 360 equidistantly spaced about the circumference of the outer surface 350 of piston 340; however, in other embodiments, the number of recesses 360 may vary. In still other embodiments, recess 360 may comprise an annular recess formed in the outer surface 350 of piston 340. In the configuration described above, recesses 360 are configured to permit fluid communication and flow through the interface formed between seal assembly 122 and recesses 360 as setting tool 300 is actuated from a run-in position to a full-stroke position, thereby permitting pressurized fluid trapped in pressure chamber 182 to vent to the surrounding wellbore environment.

Piston 340 includes an annular first shoulder 354 and an annular second shoulder 356 axially spaced from first shoulder 354 whereby seal assembly 159 is positioned axially between shoulders 354, 356. The sealing engagement of seal assembly 128 and seal assembly 159 forms an annular sealed chamber 366 extending axially between seal assembly 128 and seal assembly 159. Unlike the sealed chamber 136 of the setting tool 100 shown in FIGS. 2-12 which may be filled with an uncompressible fluid such as oil, sealed chamber 366 of setting tool 100 is filled with a compressible fluid (e.g., air, nitrogen, etc.). In this configuration, travel of piston 340 in a first axial direction (indicated by arrow 331 in FIG. 18) towards the first end 304 of housing 302 (i.e., the uphole direction when setting tool 300 is disposed in a wellbore) results in compression of the compressible fluid disposed in sealed chamber 366.

In some embodiments, sealed chamber 366 is sealed at the surface prior to insertion of setting tool 300 into a wellbore (e.g., wellbore 4) with compressible fluid at atmospheric pressure (e.g., approximately 14 pounds per square inch (PSI) to 15 PSI) filling sealed chamber 366, and thus sealed chamber 366 may comprise an atmospheric chamber. With sealed chamber 366 filled with a compressible fluid at atmospheric pressure, pressure within the wellbore is not communicated to first shoulder 354 of piston 340. Given that fluid pressure acting against first shoulder 354 exerts a pressure force on piston 340 in a second axial direction (indicated by arrow 333 in FIG. 18) towards the second end 306 of housing 302 (i.e., the downhole direction when setting tool 300 is disposed in the wellbore), by preventing wellbore pressure from being communicated to first shoulder 354 of piston 340, the amount of overbalance force (i.e., the wellbore pressure force urging setting tool 300 to remain in the run-in position) may be optimized by adjusting the difference between an inner diameter 128D (shown in FIG. 20) defined by seal assembly 128 and an inner diameter 122D (shown in FIG. 20) defined by seal assembly 122, where inner diameter 128D is greater than inner diameter 122D. In some embodiments, the ratio between inner diameter 128D and inner diameter 122D is approximately about 1.09 to 1. In some embodiments, travel of piston 340 in second axial direction 333 relative outer housing 302 is restricted when setting tool 300 is in the run-in position and travel of piston 340 in first axial direction 331 relative outer housing 302 is restricted when setting tool 300 is in the full-stroke position.

In the manner described above, the pressure force acting against second shoulder 356 of piston 340 may be minimized (e.g., via utilizing a more economical power charge 180 that creates relatively less pressure following ignition) to thereby reduce stress applied to setting tool 300 during actuation from the run-in position to the full stroke position. Moreover, in conventional setting tools exposure of the piston to wellbore pressure may constrain the sizing of shoulders and other surfaces of the piston exposed to wellbore pressure as an increased size of the shoulder or other surface may result in additional downward pressure force acting against the piston and resisting actuation of the setting tool. However, given that first shoulder 354 is not exposed to wellbore pressure when setting tool 300 is in the run-in position, the surface area of first shoulder 354 may be tailored to the particular application without substantially increasing the pressure force applied to first shoulder 354 to which piston 340 must overcome when setting tool 300 is actuated from the run-in position to the full-stroke position.

Referring now to FIGS. 21-24, as piston 340 strokes in the first axial direction 331 when setting tool 300 is actuated from the run-in position to the full-stroke position, compressible fluid disposed in sealed chamber 366 is compressed by first shoulder 354 of piston 340 as the volume of sealed chamber 366 decreases in size. In some applications, without venting sealed chamber 366, the pressure force acting against first shoulder 354 in the second axial direction 333 may equal or exceed the pressure force acting on second shoulder 356 in the first axial direction 331 from the ignition of power charge 180. Thus, without venting sealed chamber 366 during the actuation of setting tool 300 from the run-in position to the full-stroke position, in the full-stroke position a net pressure force may act against piston 340 in the second axial direction 333 to return setting tool 300 to the run-in position.

In order to avoid the undesirable scenario described above, in this embodiment, the outer surface 350 of piston 340 comprises a plurality of circumferentially spaced, axially extending pressure-equalizing grooves 370 configured to equalize pressure between sealed chamber 366 and the surrounding wellbore environment at a predefined point along the axial travel of piston 340 as setting tool 300 is actuated from the run-in position to the full-stroke position. Each pressure-equalizing groove 370 of piston 340 includes a first end 372 and a second end 374 opposite the first end 372 and positioned axially between first end 372 and first shoulder 354 of piston 340. In this embodiment, piston 340 comprises three pressure-equalizing grooves 370 spaced equidistantly apart along the circumference of piston 340; however, in other embodiments, the number of pressure-equalizing grooves 370 formed in the outer surface 350 of piston 340 may vary.

Figure 21:
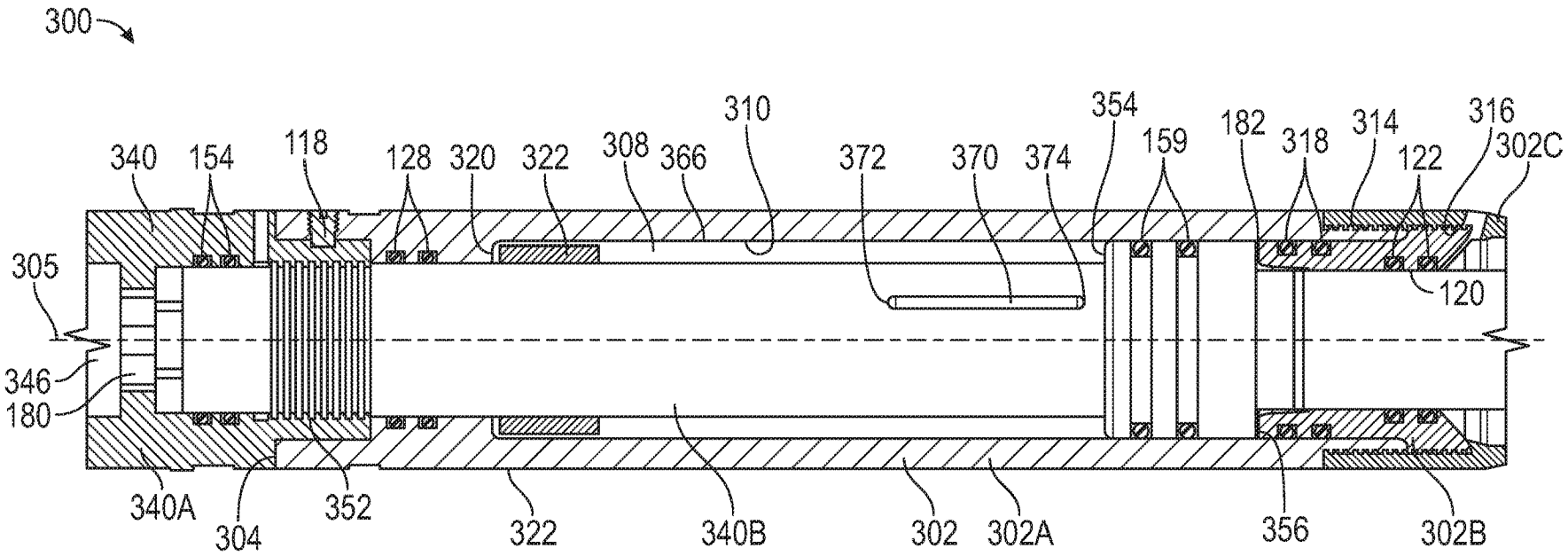

In the configuration of piston 340 described above, when setting tool 300 is in the run-in position shown in FIG. 21, seal assembly 122 seal against the outer surface 350 of piston 340 thereby sealing pressure chamber 182 from the surrounding wellbore environment, and seal assembly 128 sealingly engage the outer surface 350 of piston 340 thereby sealing atmospheric chamber 366 from the surrounding wellbore environment and maintaining pressure within atmospheric chamber 366 substantially below wellbore pressure. In some embodiments, atmospheric chamber 366 is maintained at a pressure equal to or slightly above atmospheric pressure after setting tool 300 has been lowered through wellbore 4. As piston 340 travels in first axial direction 331 during the actuation of setting tool 300 from the run-in to the full-stroke position, setting tool 300 enters a mid-stroke position (not necessarily equidistant or halfway between the run-in and full-stroke positions) shown in FIGS. 22, 23 in which the first end 372 of each pressure-equalizing groove 370 axially aligns with a first of the annular seals of seal assembly 128 and a first end 362 of each recess 360 axially aligns with a first seal of seal assembly 122.

As the setting tool 300 continues to actuate towards the full-stroke position shown in FIG. 24 from the mid-stroke position shown in FIGS. 22, 23, the first end 372 of each pressure-equalizing groove 370 passes each of the seals of seal assembly 128 at substantially the same as the first end 362 of each recess 360 passes each of the seals of seal assembly 122. In other words, as piston 340 continues to travel in the first axial direction 331 from the mid-stroke position of setting tool 300, fluid communication is established between pressure chamber 182 and the surrounding wellbore environment at substantially the same point in time as fluid communication is established between sealed chamber 366 and the surrounding environment. Thus, in this embodiment, pressure chamber 182 is vented to the surrounding wellbore environment at substantially the same point in time as sealed chamber 366 is vented to the surrounding wellbore environment whereby fluid pressure is equalized between pressure chamber 182 and sealed chamber 366. In this manner, pressure from compressed fluid in sealed chamber 366 is prevented from interfering with the actuation of setting tool 300 from the mid-stroke position to the full-stroke position. Moreover, by venting sealed chamber 366 prior to reaching the full-stroke position, pressure within sealed chamber 366 may be minimized during the actuation of setting tool 300 thereby minimizing the stress applied to setting tool 300 during actuation from the run-in position to the full-stroke position. Additionally, given that pressure in sealed chamber 366 and, in-turn, the pressure force applied to first shoulder 354 of piston 340 is minimized during sealed chamber 366 during the actuation of setting tool 300, a more economical power charge 180 configured to create relatively less pressure in response to ignition may be utilized.

Referring to FIGS. 17, 18, 25, and 26, in addition to the housing 302 and piston 340 described above, setting tool 300 also includes a cross-over 380 and a piston adapter 390 to permit setting tool 300 to interface with a variety of sizes or classes of frac plugs. Depending upon the application, the frac plug set by setting tool 300 may vary in configuration, requiring setting tool 300 to provide a plurality of interfaces for coupling to the plurality of frac plugs of varying classes. Particularly, setting tool 300 is configured to provide a first configuration or interface (indicated by arrow 381 in FIG. 25) configured to interface and couple with a first class of frac plugs via first frac plug adapter kit 400 (shown as an example in FIG. 25) and a second configuration or interface (indicated by arrow 383 in FIG. 26) configured to interface and couple with a second class of frac plugs via a second downhole or frac plug adapter kit 440 (shown as an example in FIG. 26), where a maximum outer diameter of the first class of frac plugs is different from a maximum outer diameter of the second class of frac plugs.

In the embodiment of FIGS. 17, 18, 25, and 26, the first configuration 381 is for coupling setting tool 300 with the first frac plug adapter kit 400 having a first outer diameter 400D, while second configuration 383 is for coupling setting tool 300 with the second frac plug adapter kit 440 having a second outer diameter 440D which is less than the first outer diameter 400D. The maximum outer diameter 400D of first frac plug adapter kit 400 may be greater than the maximum outer diameter 440D of second frac plug adapter kit 440 to enable first frac plug adapter kit 400 to connect with the relatively larger frac plugs of the first class.

In some embodiments, setting tool 300 may interface and couple with a frac plug of the first class configured to sealingly engage a casing string having a diameter equal to or greater than 5.5 inches when in the first configuration 381 via first frac plug adapter kit 400. In other words, frac plugs of the first class may have a maximum outer diameter of approximately 5.5 inches once they are set by setting tool 300. In some embodiments, the first class of frac plugs includes frac plug configured to be set by the size 20, model E-4™ wireline pressure setting assembly (WLPSA™) produced by Baker Hughes, a GE company, of 17021 Aldine Westfield Houston, Tex. 77073. In certain embodiments, setting tool 300 may interface and couple with a frac plug of the second class configured to sealingly engage a casing string having a diameter equal to or lesser than 5 inches when in the second configuration via second frac plug adapter kit 440. In other words, frac plugs of the second class may have a maximum outer diameter of approximately 5.0 inches once they are set by setting tool 300, and thus may have a smaller maximum outer diameter than frac plugs of the first class. In certain embodiments, the second class of frac plugs includes frac plug configured to be set by the size 10, model E-4™ WLPSA™ produced by Baker Hughes, a GE company, of 17021 Aldine Westfield Houston, Tex. 77073.

Tubular segment 302C of housing 302, which is also referred to herein as cylinder head 302C, along with cross-over 380 and piston adapter 390 enable setting tool 300 to switch between configurations 381, 383 depending upon the application. In this embodiment, the outer surface 312 of cylinder head 302C includes a releasable or threaded connector 376 proximal the second end 306 of housing 302. Cross-over 380 of setting tool 300 includes a central bore or passage defined by a generally cylindrical inner surface 382, a generally cylindrical outer surface 384, a first or internal connector 386 positioned on the inner surface 382, and a second or external connector 388 positioned on outer surface 384. Threaded connector 386 comprises a common thread or connector-type for setting sleeves of frac plug adapter kits configured to couple with frac plugs of the second class (e.g., frac plug adapter kit 440) while threaded connector 388 comprises a common thread or connector-type for setting sleeves of frac plug adapter kits configured to couple with frac plugs of the first class (e.g., frac plug adapter kit 400). For example, threaded connector 386, may comprise 3.0000-8 stub Acme threads while threaded connector 388 may comprise 3.9375-8 Stub Acme threads having a maximum major diameter of 3.9375 inches. In some embodiments, internal connector 386 of cross-over 380 has a diameter of approximately 3 inches and external connector 388 of cross-over 380 has a diameter of approximately 3 and 15/16 inches. Internal connector 386 of cross-over 380 is configured to releasably or threadably connect with the connector 376 of cylinder head 302C. Additionally, external connector 388 is configured to releasably or threadably connect to an internal connector 412 of a setting sleeve 410 of the first frac plug adapter kit 400, the first frac plug adapter kit 400 configured to interface and couple with a frac plug of the first class described above.

Piston adapter 390 of setting tool 300 includes a central bore or passage defined by a generally cylindrical inner surface 392, and a generally cylindrical outer surface 394. Additionally, piston adapter 390 includes a first internal connector 396 and a second internal connector 398 each positioned on the inner surface 392, and an external connector 399 positioned on outer surface 394. The first internal connector 396 of piston mandrel 390 is positioned proximal a first end of piston adapter 390 and is configured to releasably or threadably couple with a connector 343 positioned on the outer surface 350 of piston 340 proximal the second end 344 of piston 340. The second internal connector 398 is positioned proximal a second end of piston adapter 390 opposite the first end. In some embodiments, external connector 404 is equivalent to the external connector located at the downhole end of the size 20, model E-4™ WLPSA™ and is configured for use with frac plug adapter kits connectable with frac plugs of the first class. In some embodiments, internal connector 398 is equivalent to the internal connector located on the downhole end of the size 10, model E-4™ WLPSA™ and is configured for use with frac plug adapter kits connectable with frac plugs of the second class. Although in this embodiment piston adapter 390 includes a plurality of internal connectors in first internal connector 396 and second internal connector 398, in other embodiments, piston adapter 390 may include a single internal connector extending substantially from the first end of piston adapter 390 to the second end thereof.

Figure 25:
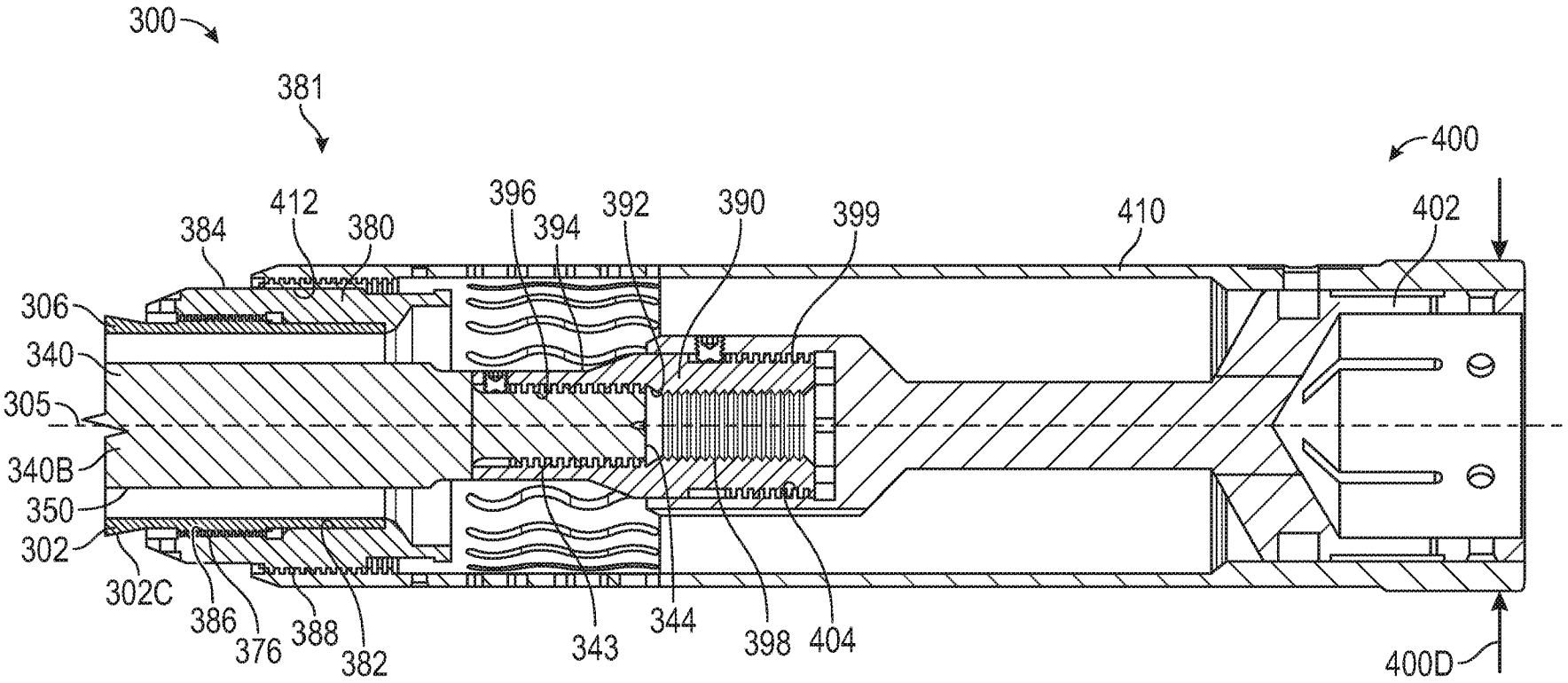
FIG. 25 is a zoomed-in, side cross-sectional view of the setting tool of FIG. 17 in a first configuration in accordance with principles disclosed herein.

As shown particularly in FIG. 25, the external connector 399 of piston adapter 390 is configured to releasably or threadably couple to an internal connector 404 of the shear cap 402 of first frac plug adapter kit 400. Shear cap 402 of first frac plug adapter kit 400 is configured to releasably or frangibly couple with a mandrel of a frac plug (not shown in FIG. 25) of the first class described above. As described above external connector 376 of cylinder head 302C is configured to couple with internal connector 386 of cross-over 380 and external connector 388 of cross-over 380 is configured to couple with internal connector 412 of setting sleeve 410 to couple housing 302 with setting sleeve 410. Setting sleeve 410 is positionable about the mandrel of the frac plug of the first class and is configured to impart a compressive force to a sealing element or elastomeric packer of the frac plug whereby the sealing element is set or actuated to sealingly engage an inner surface of the casing (e.g., casing string 12 shown in FIG. 1) in which the frac plug is disposed. Thus, in the configuration described above, by utilizing cross-over 380 and mandrel or piston adapter 390, setting tool 300 is configured to interface and couple with a frac plug of the first class described above via first frac plug adapter kit 400.

Figure 26:
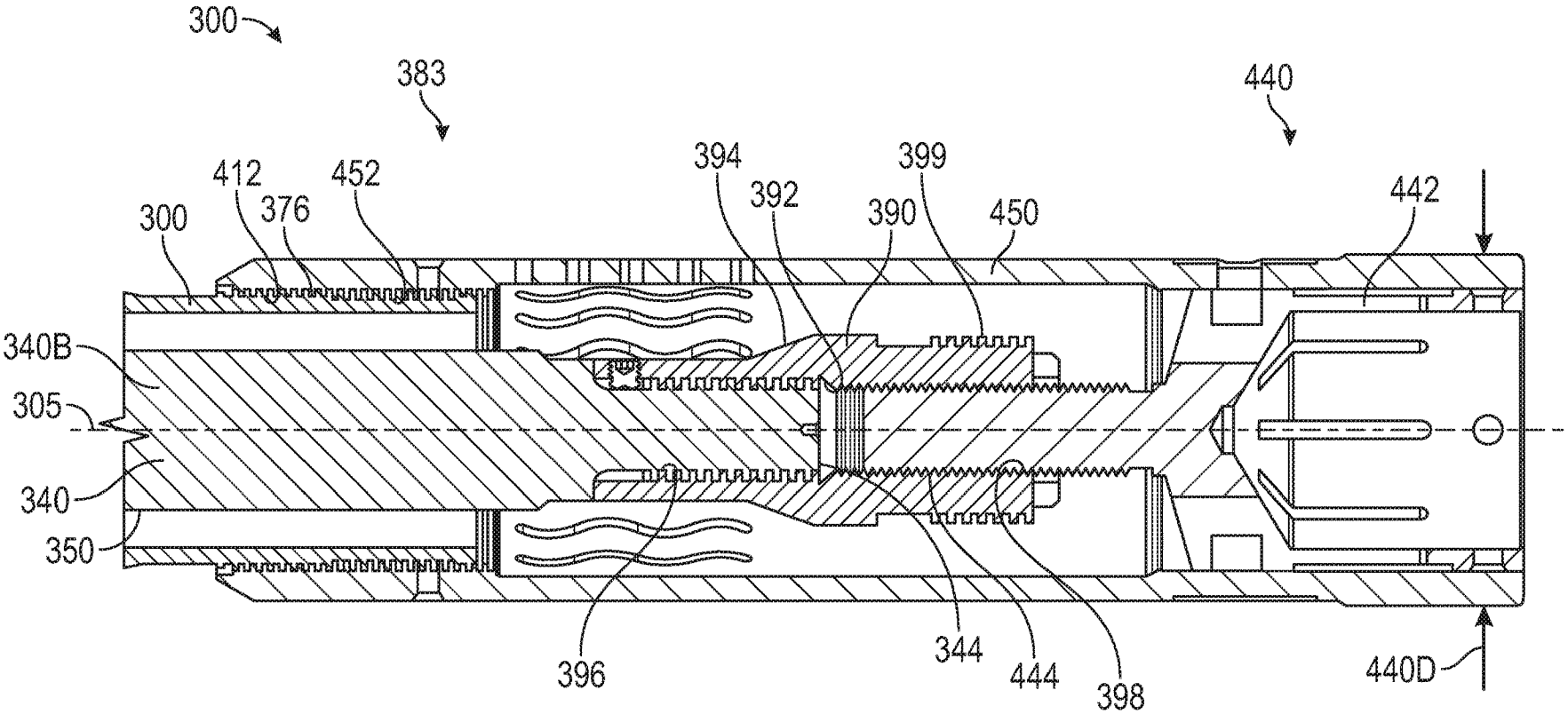
FIG. 26 is a zoomed-in, side cross-sectional view of the setting tool of FIG. 17 in a second configuration in accordance with principles disclosed herein.

As shown particularly in FIG. 26, in the second configuration 383 setting tool 300 may utilize cylinder head 302C and piston adapter 390 to also interface and couple with a frac plug of the second class (not shown in FIG. 26) described above via the second frac plug adapter kit 440 shown in FIG. 26. Second frac plug adapter kit 440 includes a shear cap 442 that includes an external connector 444 positioned on an outer surface thereof proximal a first end of the shear cap 442. Second internal connector 398 of piston adapter 390 is configured to releasably or threadably couple with the external connector 444 of shear cap 442 to connect piston 340 of setting tool 300 with shear cap 442. The shear cap 442 of second frac plug adapter kit 440 is configured to releasably or frangibly couple with a mandrel of a frac plug of the second class described above.

Second frac plug adapter kit 440 also includes a setting sleeve 450 comprising an internal connector 452 positioned on an inner surface thereof proximal a first end of setting sleeve 450. Given that frac plugs of the second class have a relatively smaller diameter than frac plugs of the first class as described above, cross-over 380 is not use to connect housing 302 with setting sleeve 450, and instead, connector 376 directly couples with internal connector 452 of setting sleeve 450 to couple housing 302 of setting tool 300 with the setting sleeve 450 of second frac plug adapter kit 440. The setting sleeve 450 of second frac plug adapter kit 440 is positionable about the mandrel of the frac plug of the second class and is configured to impart a compressive force to a sealing element or elastomeric packer of the frac plug whereby the sealing element is set or actuated to sealingly engage an inner surface of the casing in which the frac plug is disposed.

In the manner described above, cylinder head 302C, cross-over 380, and piston adapter 390 permit setting tool 300 to interface and couple with a plurality of classes of frac plugs suitable for varying applications, including applications where setting tool 300 interfaces with a relatively large diameter frac plug configured to seal against a casing string having a relatively large diameter (i.e., frac plugs of the first class configured to seal against casing strings having a diameter of 5.5 inches and greater) and applications where setting tool 300 interfaces with a relatively small diameter frac plug configured to seal against a casing string having a relatively small diameter (i.e., frac plugs of the second class configured to seal against casing strings having a diameter of 5 inches or less). Moreover, cylinder head 302C, cross-over 380, and piston adapter 390 permit setting tool 300 to interface and couple with frac plugs of the first and second classes using typical, industry standard adapter kits 400, 440, respectively, associated with frac plugs of those respective classes. For example, first frac plug adapter kit 400 may comprise an industry standard adapter kit for interfacing with the size 20, model E-4™ WLPSA™, while second frac plug adapter kit 440 may comprise an industry standard adapter kit for interfacing with the size 10, model E-4™ WLPSA™.

Thus, a plurality of specialized setting tools (e.g., a larger diameter setting tool for coupling with frac plugs of the first class and a smaller diameter setting tool for coupling with frac plugs of the second class) are not required for coupling with frac plugs of the first class and with frac plugs of the second class. Instead, piston adapter 390 and cross-over 380 permit a single setting tool (setting tool 300 in this embodiment) to couple with both frac plugs of the first class and with frac plugs of the second class having a smaller diameter than frac plugs of the first class. In this manner, setting tool 300 may be utilized in a greater variety of applications encompassing a broader range of casing string diameters than conventional setting tools limited to coupling with only frac plugs of the first class or frac plugs of the second class.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A setting tool for actuating a downhole plug in a wellbore, comprising:

a housing comprising a central passage;

a piston slidably disposed in the housing and comprising a central passage, and wherein the piston comprises a first position in the housing and a second position the housing spaced from the first position in a first axial direction;

an atmospheric chamber filled with compressible fluid formed radially between the piston and the housing, and wherein the atmospheric chamber is sealed from an environment surrounding the setting tool when the piston is in the first position;

an annular first seal assembly positioned in a first groove formed on an inner surface of the housing, wherein the first seal assembly sealingly engages an outer surface of the piston and restricts fluid communication between the atmospheric chamber and the environment surrounding the setting tool;

an annular second seal assembly positioned in a groove formed on the outer surface of the piston, wherein the second seal assembly sealingly engages the inner surface of the housing and wherein the atmospheric chamber extends axially form the first seal assembly to the second seal assembly; and an annular third seal assembly positioned in the second groove formed on the inner surface of the housing, wherein the third seal assembly sealingly engages the outer surface of the piston;

wherein the second seal assembly is positioned axially between the first seal assembly and the third seal assembly and wherein an inner diameter of the first seal assembly is greater than an inner diameter of the third seal assembly;

wherein, in response to a pressurization of the central passage of the piston, the setting tool is configured to displace the piston from the first position to the second position and compress the compressible fluid within the atmospheric chamber.

2. The setting tool of claim 1, wherein:

a groove is formed in the outer surface of the piston, and wherein the piston comprises a third position wherein the groove is positioned axially between a first end and a second end of the first seal assembly whereby fluid communication is provided between the atmospheric chamber and the environment surrounding the setting tool.

3. The setting tool of claim 2, wherein:

an annular pressure chamber extends from the second seal assembly to the third seal assembly, and wherein the pressure chamber is in fluid communication with the central passage of the piston via a port formed in the piston.

4. The setting tool of claim 3, wherein:

the second seal assembly restricts fluid communication between the pressure chamber and the environment surrounding the setting tool when the piston is in the first position;

the outer surface of the piston comprises a recess formed therein, and wherein the second seal assembly is positioned axially between the recess and the first seal assembly when the piston is in the first position; and at least a portion of the recess is positioned axially between the second seal assembly and the first seal assembly when the piston is in the third position.

5. The setting tool of claim 3, further comprising:

an annular impact ring positioned about the piston and axially between the and the first seal assembly and the second seal assembly;

wherein the impact ring is configured to impact the piston when the setting tool is actuated from the first position to the second position.

6. The setting tool of claim 5, wherein the impact ring comprises a material having a hardness that is less than a hardness of a material comprising the housing.

7. The setting tool of claim 1, wherein the setting tool further comprises a piston adapter configured to releasably couple to the piston via a first internal connector of the piston adapter that is positioned on an inner surface thereof, and wherein the piston adapter comprises a second internal connector positioned on the inner surface of thereof and an external connector positioned on an outer surface thereof.

8. The setting tool of claim 1, further comprising:

a mandrel slidably disposed in the housing and comprising a first end coupled to the piston, and a second end configured to couple with a mandrel of the downhole plug;

an annular pressure chamber positioned radially between an inner surface of the housing and an outer surface of the mandrel, and wherein the pressure chamber is in fluid communication with the central passage of the piston via a port formed in the piston; and an annular impact ring positioned about the mandrel, and wherein the impact ring is positioned axially between the pressure chamber and the second end of the mandrel and within a vent chamber that is exposed to an environment surrounding the setting tool when the piston is in the first position, and wherein the impact ring is configured to impact a shoulder of the mandrel when the piston is actuated from the first position to the second position in response to a pressurization of the central passage of the piston.

9. A setting tool for actuating a downhole plug in a wellbore, comprising:

a housing comprising a central passage; and a piston slidably disposed in the housing and comprising a central passage, a first end, and a second end, wherein the piston comprises a first position in the housing and a second position the housing spaced from the first position in a first axial direction;

a mandrel slidably disposed in the housing and comprising a first end coupled to a second end of the piston, and a second end configured to couple with a mandrel of the downhole plug; and an annular pressure chamber positioned radially between an inner surface of the housing and an outer surface of the mandrel, and wherein the pressure chamber is in fluid communication with the central passage of the piston via a port formed in the piston; and an annular impact ring positioned about the mandrel, and wherein the impact ring is positioned axially between the pressure chamber and the second end of the mandrel and within a vent chamber that is exposed to an environment surrounding the setting tool when the piston is in the first position, and wherein the impact ring is configured to impact a shoulder of the mandrel when the piston is actuated from the first position to the second position in response to a pressurization of the central passage of the piston.

10. The setting tool of claim 9, wherein the impact ring comprises a material having a hardness that is less than a hardness of a material comprising the housing.

11. The setting tool of claim 9, further comprising:

a sealed chamber formed around the piston and which is sealed from an environment surrounding the setting tool by an annular first seal assembly;

a radial port formed in the housing and comprising a vent orifice, wherein a plug is removeably positioned in the radial port;

wherein, in response to the pressurization of the central passage of the piston of the setting tool, the setting tool is configured to eject the plug from the radial port to permit fluid communication between the sealed chamber and the environment surrounding the setting tool.

12. The setting tool of claim 11, wherein a ratio of a surface area of the vent orifice and an axially-projected surface area of the piston is between 0.1% and 0.95%.

13. The setting tool of claim 11, wherein the sealed chamber is filled with hydraulic oil.

14. The setting tool of claim 9, further comprising a sealed chamber formed around the piston and which is sealed from an environment surrounding the setting tool by an annular first seal assembly, and wherein the sealed chamber comprises an atmospheric chamber filled with compressible fluid.

15. The setting tool of claim 9, further comprising a piston adapter configured to releasably couple to the second end of the piston via a first internal connector of the piston adapter that is positioned on an inner surface thereof, and wherein the piston adapter comprises a second internal connector positioned on the inner surface of thereof and an external connector positioned on an outer surface thereof.

16. The setting tool of claim 15, wherein a groove is formed in the outer surface of the piston, and wherein the piston comprises a third position positioned axially between the first position and the second position, and wherein fluid communication is provided between the atmospheric chamber and the environment surrounding the setting tool via the groove when the piston is in the third position.

17. A tool string disposable in a wellbore, comprising:

a downhole plug configured to seal against an inner surface of a tubular string disposed in the wellbore; and a setting tool connectable to the downhole plug, comprising:

a housing comprising a central passage;

a piston slidably disposed in the housing and comprising a central passage a first end, and a second end configured to couple with a mandrel of the downhole plug, and wherein the piston comprises a first position in the housing and a second position the housing spaced from the first position in a first axial direction; and a piston adapter configured to releasably couple to the piston via a first internal connector of the piston adapter that is positioned on an inner surface thereof, and wherein the piston adapter comprises a second internal connector positioned on the inner surface of thereof and an external connector positioned on an outer surface thereof;

wherein, in response to a pressurization of the central passage of the piston of the setting tool, the setting tool is configured to actuate the downhole plug to seal against an inner surface of a tubular string.

18. The tool string of claim 17, wherein the piston adapter is configured to couple to a first shear cap of a first downhole plug adapter kit via the external connector and to couple to a second shear cap of a second frag plug adapter kit via the second internal connector.

19. The tool string of claim 18, wherein the first downhole plug adapter kit has a maximum outer diameter which is greater than a maximum outer diameter of the second downhole plug adapter kit.

20. The tool string of claim 18, wherein the setting tool further comprises a cross-over comprising an internal connector configured to couple to a connector of the housing and an external connector configured to couple to a first setting sleeve of the first adapter kit.

21. The tool string of claim 20, wherein the connector of the housing is configured to releasably couple to a connector of a second setting sleeve of the second adapter kit.

22. The tool string of claim 17, wherein the setting tool further comprises a mandrel coupled between the piston and the mandrel of the downhole plug, and wherein the mandrel of the setting tool is welded to the mandrel via an annular seam weld.

23. The tool string of claim 17, wherein the setting tool further comprises an atmospheric chamber filled with a compressible fluid and formed around the piston.

24. The tool string of claim 17, wherein the setting tool further comprises:

an annular pressure chamber positioned radially between an inner surface of the housing and an outer surface of a mandrel coupled to the piston, and wherein the pressure chamber is in fluid communication with the central passage of the piston via a port formed in the piston; and an annular impact ring positioned about the piston and axially between the pressure chamber and the first end of the piston, and wherein the impact ring is configured to impact the piston when the setting tool is actuated from the first position to the second position.

* * * * *